US008776440B2

(12) United States Patent
Sopkowiak et al.

(10) Patent No.: US 8,776,440 B2
(45) Date of Patent: Jul. 15, 2014

(54) SASH LIMITER APPARATUS AND METHOD

(75) Inventors: John Sopkowiak, Williams, MN (US); David Lund, Detroit Lakes, MN (US)

(73) Assignee: Marvin Lumber and Cedar Company, Warroad, MN (US)

( * ) Notice: Subject to any disclaimer, the term of this patent is extended or adjusted under 35 U.S.C. 154(b) by 0 days.

(21) Appl. No.: 13/328,776

(22) Filed: Dec. 16, 2011

(65) Prior Publication Data

US 2012/0167475 A1 Jul. 5, 2012

Related U.S. Application Data

(60) Provisional application No. 61/424,343, filed on Dec. 17, 2010, provisional application No. 61/486,813, filed on May 17, 2011.

(51) Int. Cl.
*E05B 65/08* (2006.01)

(52) U.S. Cl.
USPC ..... 49/449; 292/338; 292/DIG. 47

(58) Field of Classification Search
USPC ..... 49/176, 181, 183–185, 449; 292/338, 292/339, DIG. 20, DIG. 47, 230
See application file for complete search history.

(56) References Cited

U.S. PATENT DOCUMENTS 551,181 A * 12/1895 Dillon ..... 292/230
756,453 A 4/1904 Arens et al.
976,777 A * 11/1910 Brown ..... 292/63
1,261,274 A * 4/1918 Newsam ..... 292/63
1,724,637 A 8/1929 Bergstrom
4,095,827 A * 6/1978 Stavenau ..... 292/65
5,248,174 A * 9/1993 Matz et al. ..... 292/338
5,536,052 A 7/1996 Maier
5,575,116 A * 11/1996 Carlson et al. ..... 49/449
5,806,900 A 9/1998 Bratcher et al.
6,000,735 A 12/1999 Jourdenais
6,021,603 A 2/2000 Prete et al.
6,364,375 B1 * 4/2002 Szapucki et al. ..... 292/63

(Continued)

FOREIGN PATENT DOCUMENTS

GB 2410058 7/2005
GB 2046107 A 12/2009

(Continued)

*Primary Examiner* — Katherine Mitchell
*Assistant Examiner* — Abe Massad
(74) *Attorney, Agent, or Firm* — Schwegman, Lundberg & Woessner, P.A.

(57) ABSTRACT

A limiter system includes a base including a pin. A rocker is rotatably and translationally coupled with the pin. The rocker includes a first end including an abutment feature, a second end including a reset feature, and a slot including first and second slot ends and a slot track therebetween. The pin is translationally and rotatably received in the slot, and the pin is translational between the first and second slot ends. The rocker is configured for positioning between a first abutting position and a second resetting position. In the first abutting position, the abutment feature extends away from the base. In the second resetting position, the reset feature extends away from the base, and the abutment feature is nearer to the base than the reset feature.

27 Claims, 20 Drawing Sheets

(56) References Cited

U.S. PATENT DOCUMENTS

| | | | | |
|---|---|---|---|---|
| 6,572,158 | B2 * | 6/2003 | Szapucki et al. | 292/221 |
| 7,093,392 | B2 | 8/2006 | Derham et al. | |
| 7,296,831 | B2 | 11/2007 | Generowicz et al. | |
| D581,247 | S | 11/2008 | Durrant | |
| 7,588,271 | B1 * | 9/2009 | Lawrence | 292/241 |
| 7,600,796 | B2 * | 10/2009 | Liang et al. | 292/338 |
| 2003/0167694 | A1 * | 9/2003 | Liang | 49/183 |
| 2007/0222233 | A1 | 9/2007 | Liang et al. | |
| 2010/0019513 | A1 | 1/2010 | Generowicz et al. | |
| 2011/0113695 | A1 | 5/2011 | Derham | |
| 2012/0144752 | A1 * | 6/2012 | Piltingsrud | 49/450 |

FOREIGN PATENT DOCUMENTS

| | | | |
|---|---|---|---|
| GB | 2461079 | A | 12/2009 |
| GB | 2461108 | A | 12/2009 |
| WO | WO-99/46464 | | 9/1999 |
| WO | WO-2009/072839 | A1 | 6/2009 |
| WO | WO-2009/153562 | A1 | 12/2009 |
| WO | WO-2009/153564 | A1 | 12/2009 |

* cited by examiner

SASH LIMITER APPARATUS AND METHOD

CLAIM OF PRIORITY

This patent application claims the benefit of priority, under 35 U.S.C. §119(e), to U.S. Provisional Patent Application Ser. No. 61/424,343, entitled "SASH LIMITER APPARATUS AND METHOD," filed on Dec. 17, 2010, and to U.S. Provisional Patent Application Ser. No. 61/486,813, entitled "SASH LIMITER APPARATUS AND METHOD," filed on May 17, 2011, which applications are hereby incorporated by reference herein in their entirety.

BACKGROUND

Accidental falls from elevated windows (for instance, second-floor windows or higher) are a safety concern, especially with young children. For instance, a small child might open a window or go to an already-open window and lean out, lean against a screen, climb out, or the like. The small child could lose his/her balance or the screen could give way, and the child could fall out of the window. Depending on the height of the window above ground level, such a fall could result in injury and/or death. Certain building standards have been developed to require that windows include features to limit the amount that the windows can be opened. For instance, ASTM F2090 addresses window fall prevention devices with emergency escape (egress) release mechanisms.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1A:
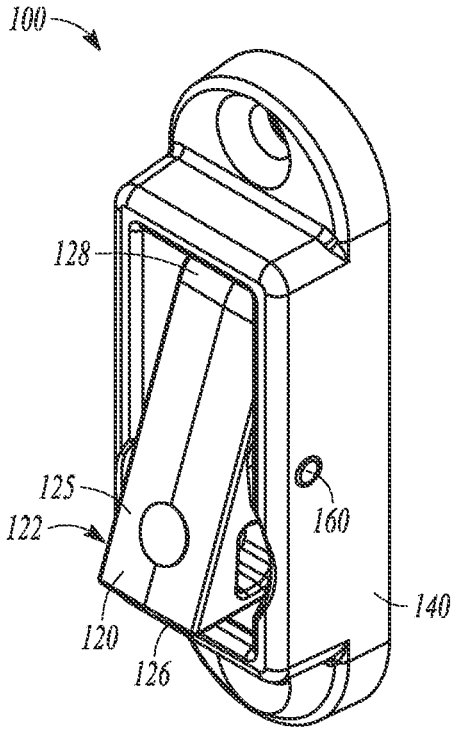
FIGS. 1A and 1B illustrate a perspective view and a side view, respectively, of an example of a sash limiter in a first position.
Figure 1B:
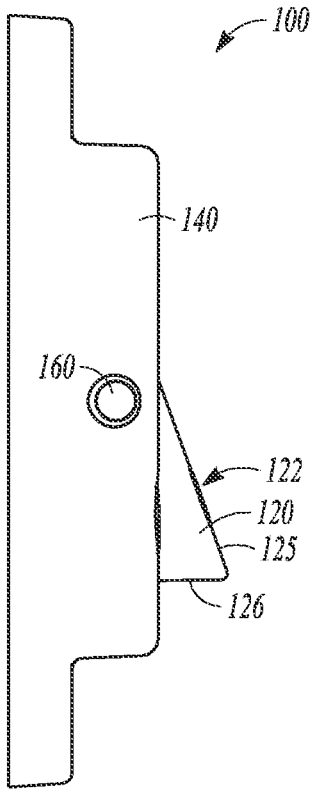
Figure 2A:
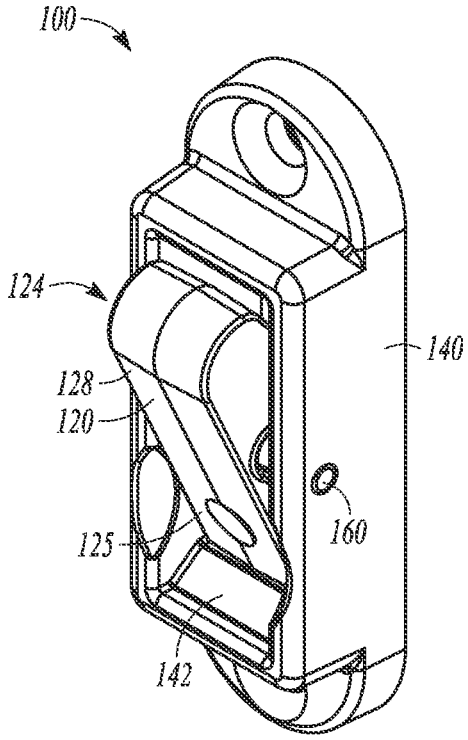
FIGS. 2A and 2B illustrate a perspective view and a side view, respectively, of an example of a sash limiter in a second position.
Figure 2B:
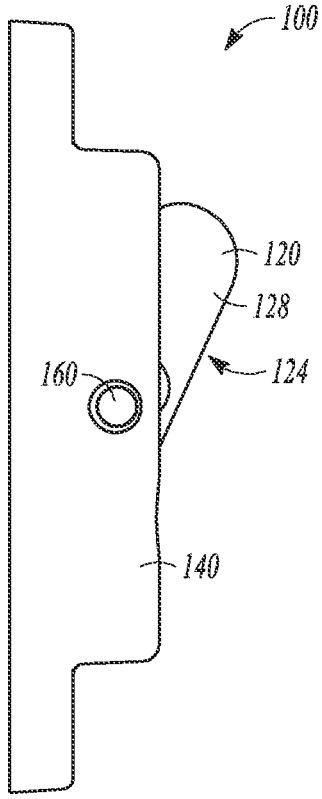
Figure 3A:
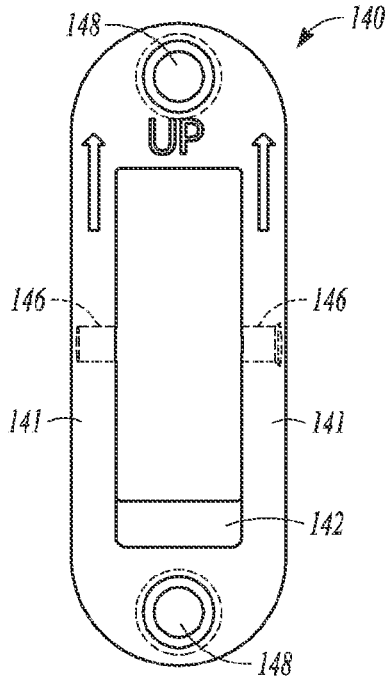
FIGS. 3A-3D illustrate a front view, a back view, a side view, and a cross-sectional view taken along line 3D-3D of FIG. 3B, respectively, of an example of a base of a sash limiter.
Figure 3B:
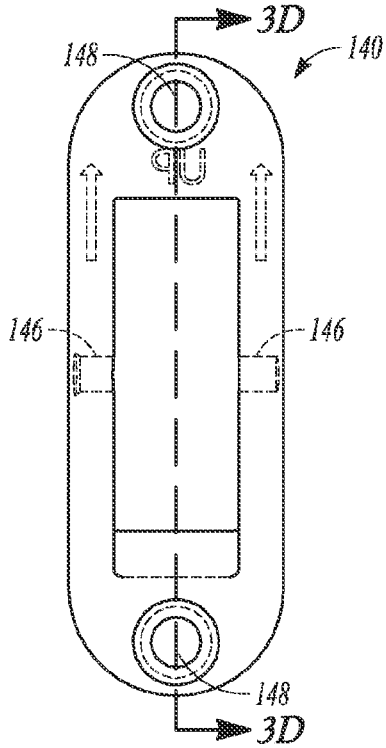
Figure 3C:
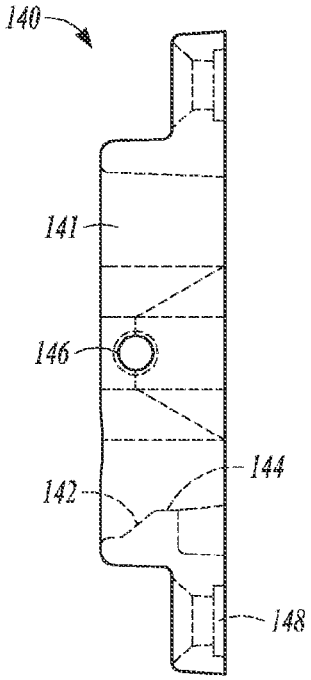
Figure 3D:
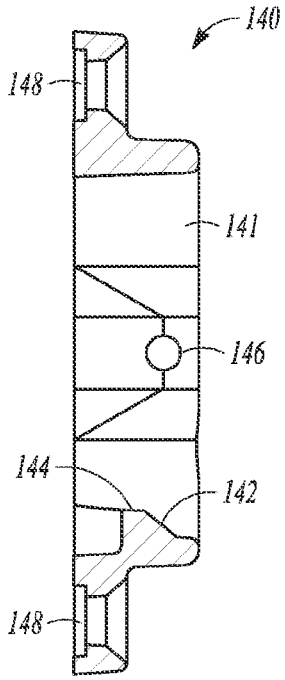

Referring the FIGS. 1A, 1B, 2A, 2B, and 9-11, an example of a sash limiter 100 is shown. In various examples, the sash limiter 100 is configured to be used with a window 10 including a frame 12 and a first sash 14 movable within the frame 12. In an example, the first sash 14 is movable within the frame 12 in a first direction A and a second direction B, the second direction B being substantially opposite the first direction A. In various examples, the direction A is an opening direction of the window 10 and direction B is a closing direction of the window 10. In an example, the window 10 includes a second sash 16. In some examples, the second sash 16 is also movable within the frame 12 in the first and second directions A, B. Although shown with respect to a vertically opening and closing window, it is contemplated that the sash limiter 100 described herein can be used in other types of windows, such as, for instance, casement windows. Also, although shown with respect to a double-hung window, it is contemplated that the sash limiter 100 described herein can be used in a window with a single movable sash. It is noted that the sash limiter 100 need not be limited to use with windows and can be further used with doors, sliding doors, swinging doors, patio doors, freezer doors, refrigerator doors, cabinet doors, skylights, roof hatch, roof access doors, and the like. In various examples, the sash limiter 100 can be used to selectively inhibit the opening of doors, sliding doors, swinging doors, patio doors, freezer doors, cabinet doors, skylights, roof hatches, roof access doors, and the like.

Figure 9:
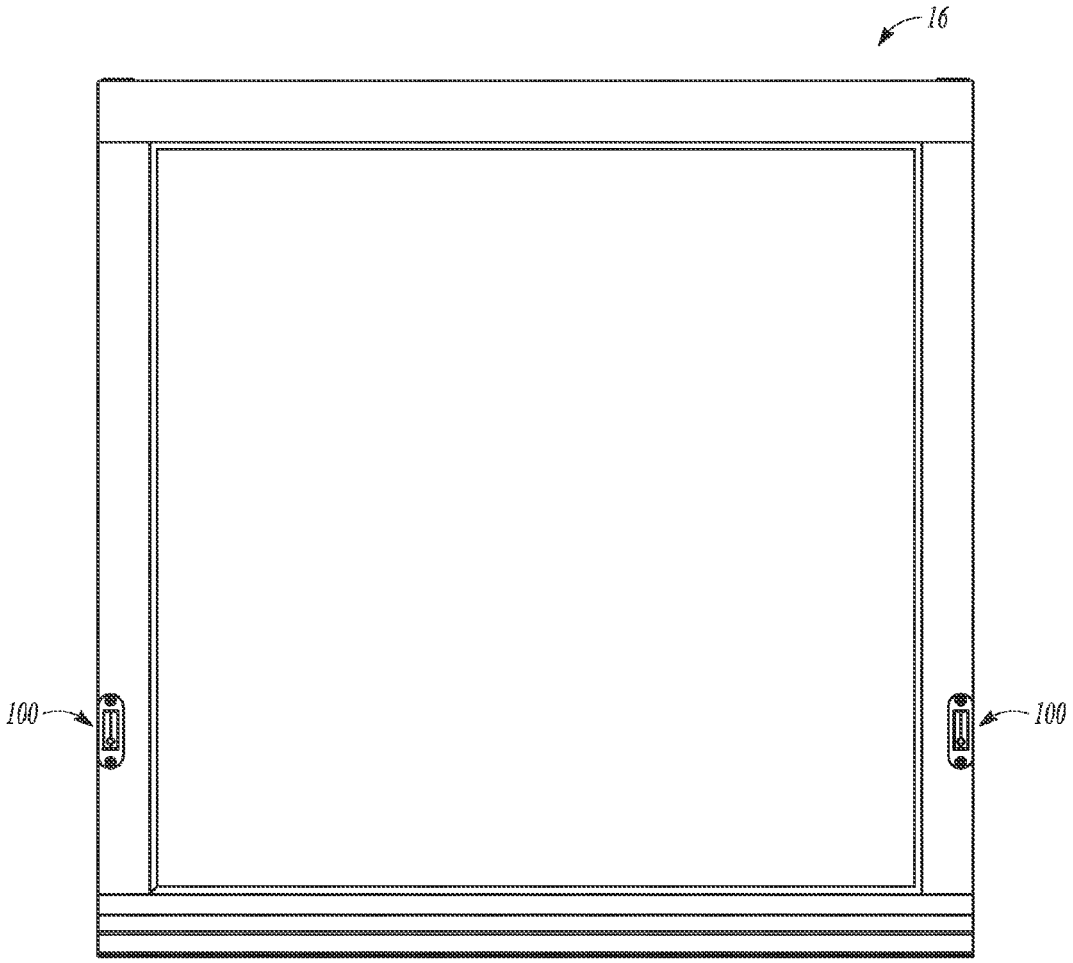
FIG. 9 illustrates a front view of examples of sash limiters attached to a window sash.
Figure 10:
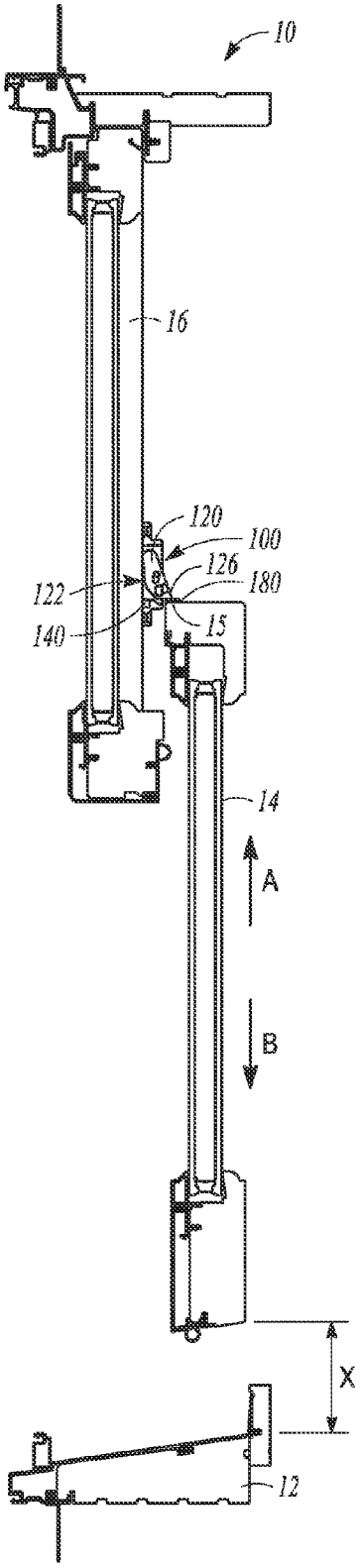
FIG. 10 illustrates a side view of an example of a sash limiter, in a first position, attached to a window.
Figure 11:
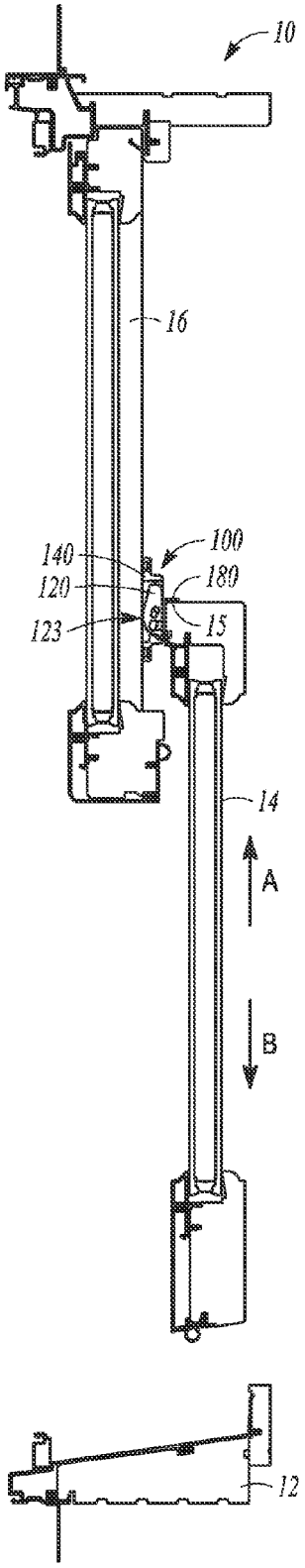
FIG. 11 illustrates a side view of an example of a sash limiter, in an intermediate position, attached to a window.
Figure 12:
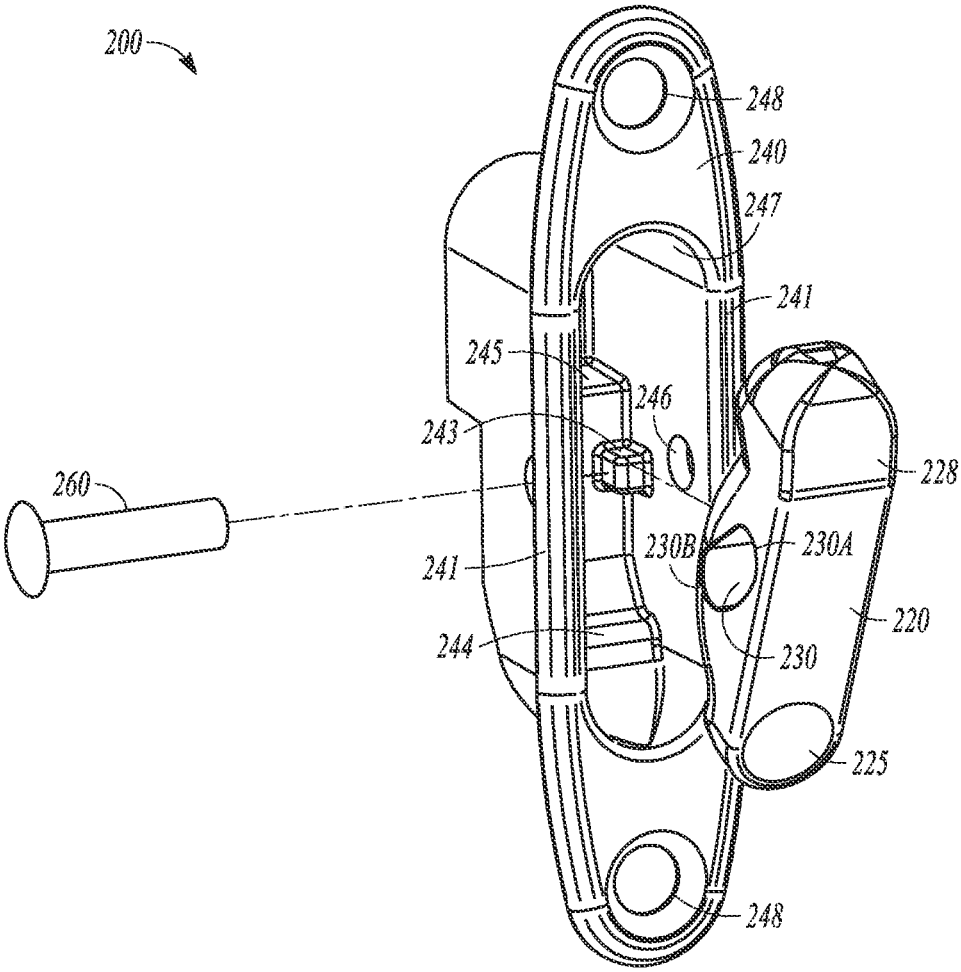
FIG. 12 illustrates an exploded perspective of an example of a sash limiter.
Figure 13A:
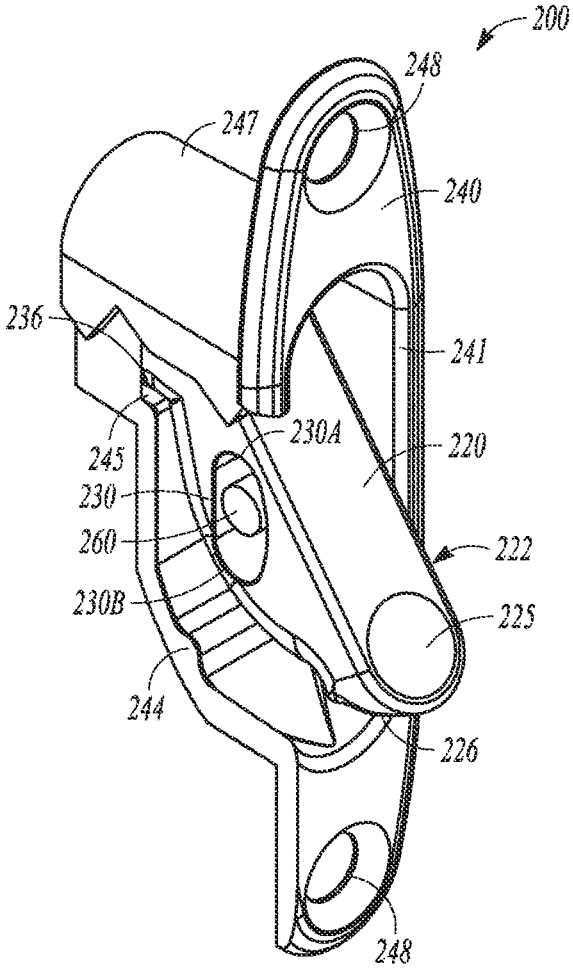
FIGS. 13A-13D illustrate a partially cutaway perspective view, a partially cutaway side view, a side view, and a front view, respectively, of an example of a sash limiter in a first position.
Figure 13B:
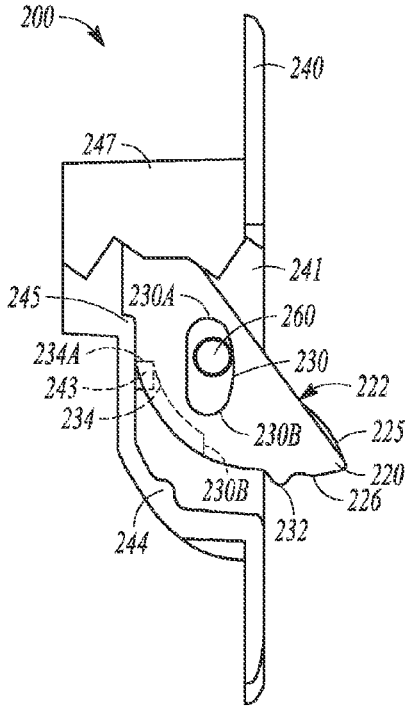
Figure 13C:
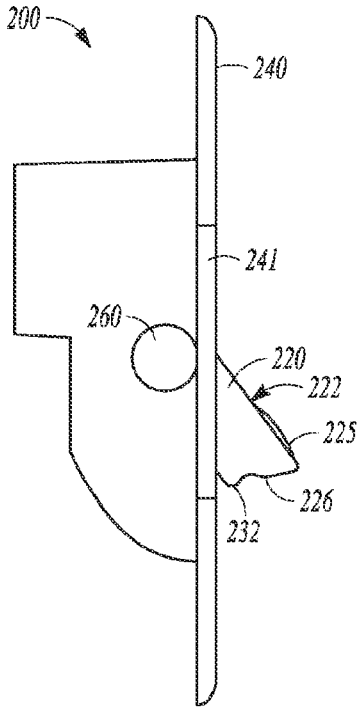
Figure 13D:
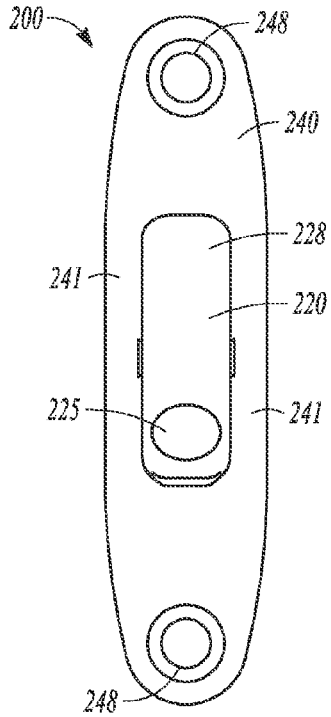
Figure 14A:
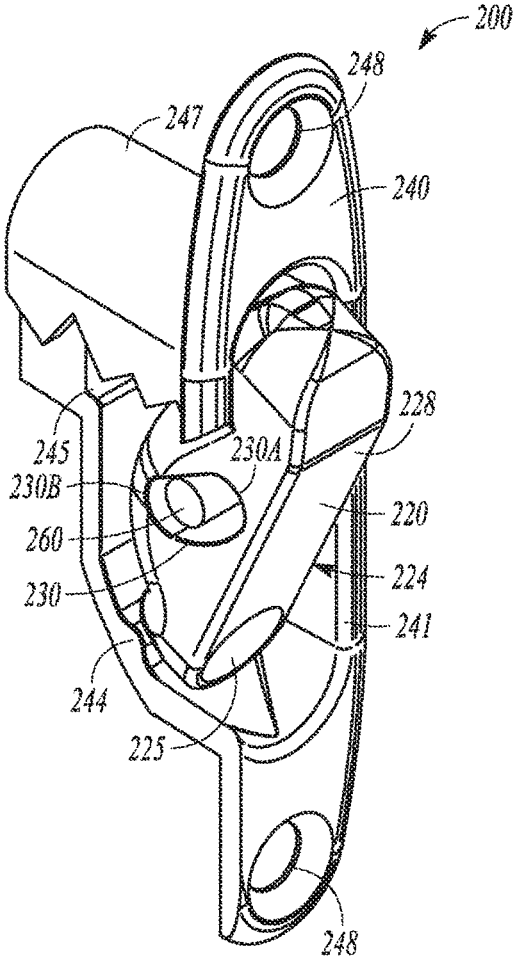
FIGS. 14A-14D illustrate a partially cutaway perspective view, a partially cutaway side view, a side view, and a front view, respectively, of an example of a sash limiter in a second position.
Figure 14B:
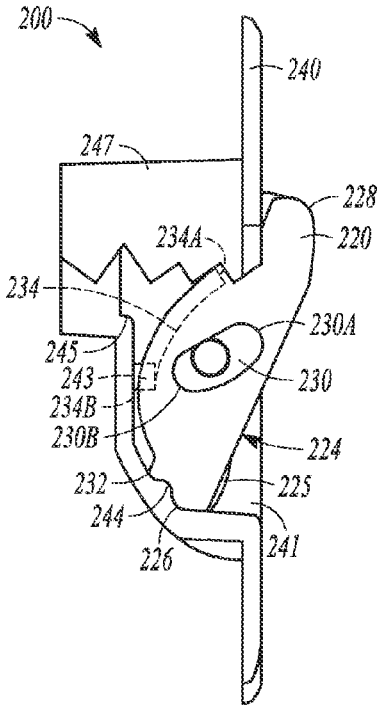
Figure 14C:
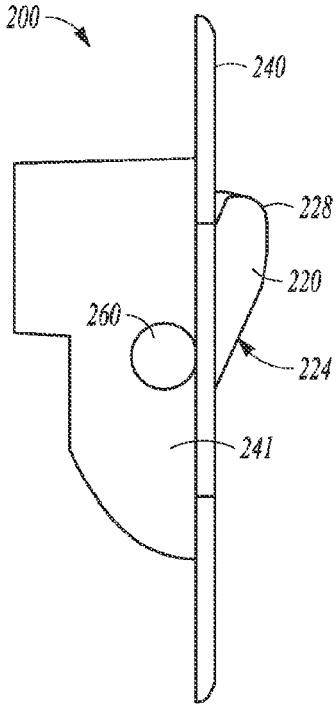
Figure 14D:
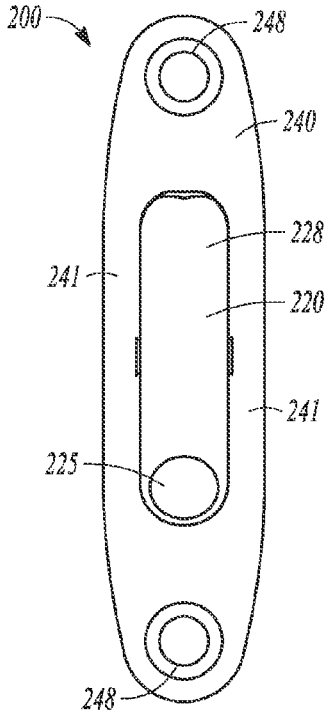
Figure 15:
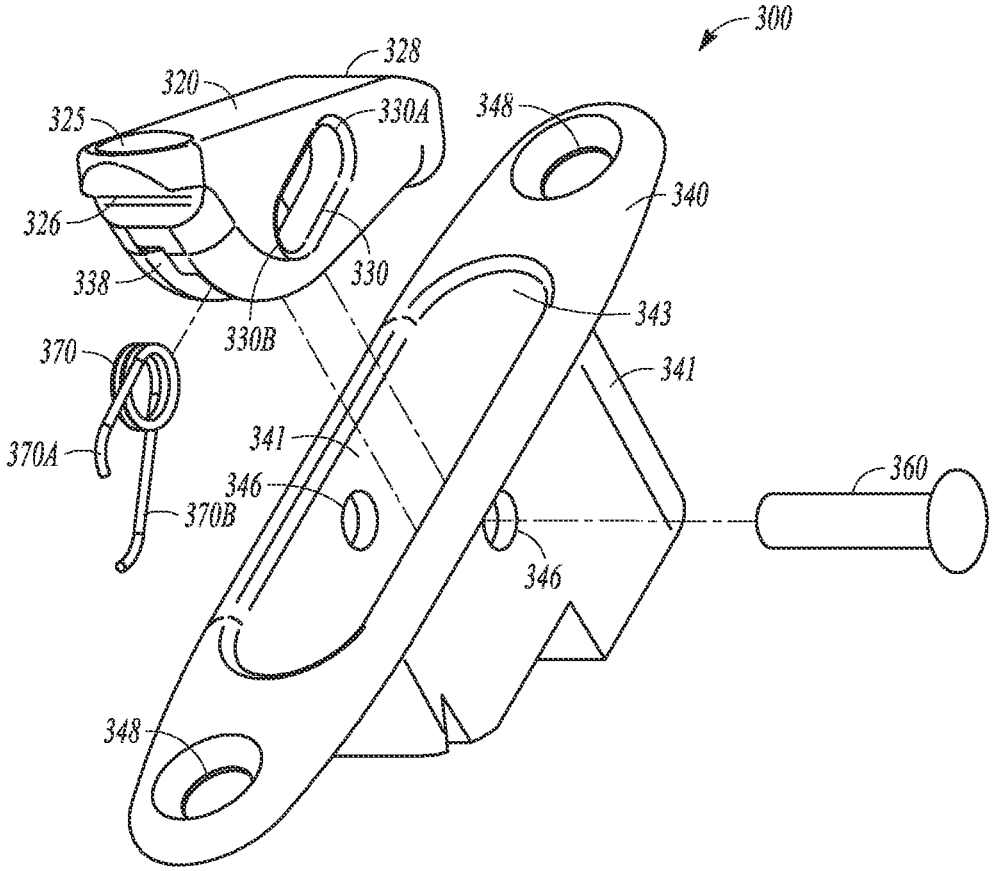
FIG. 15 illustrates an exploded perspective of an example of a sash limiter.
Figure 16A:
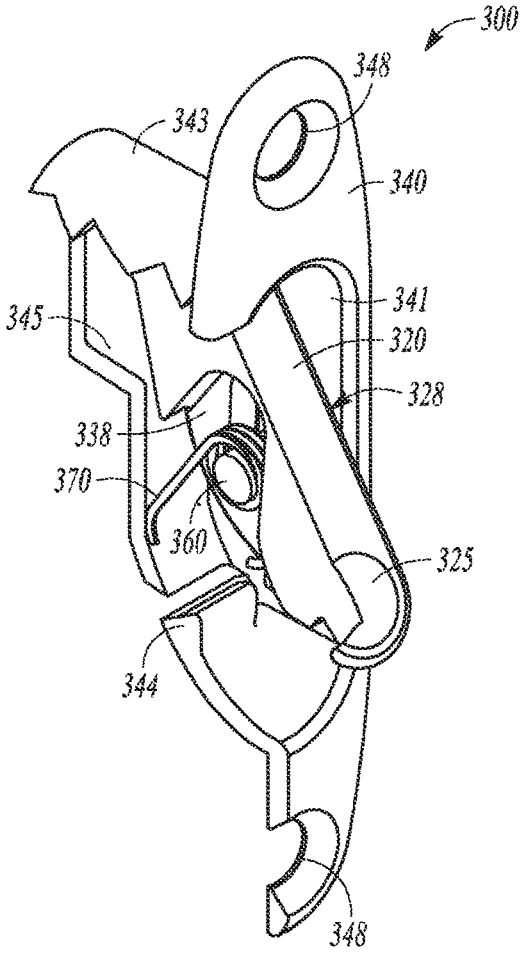
FIGS. 16A-16D illustrate a partially cutaway perspective view, a partially cutaway side view, a side view, and a front view, respectively, of an example of a sash limiter in a first position.
Figure 16B:
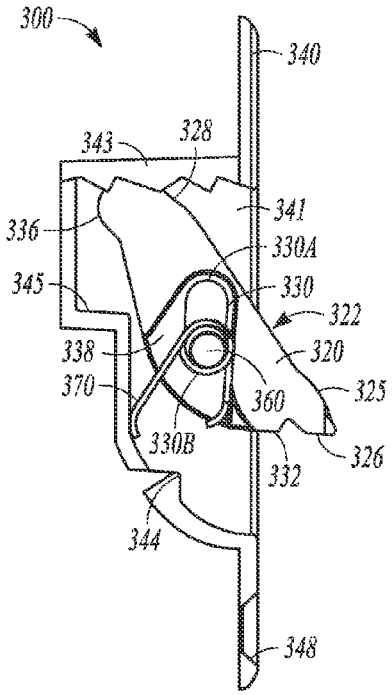
Figure 16C:
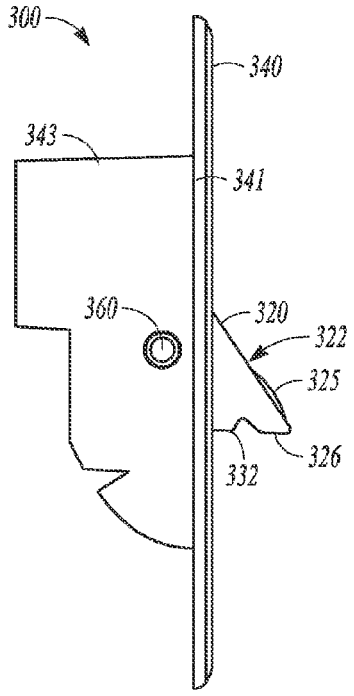
Figure 16D:
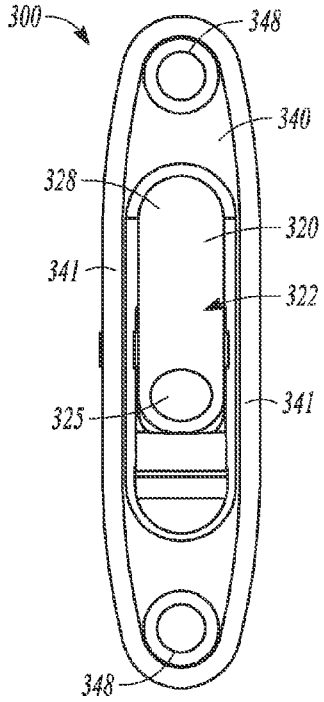
Figure 17A:
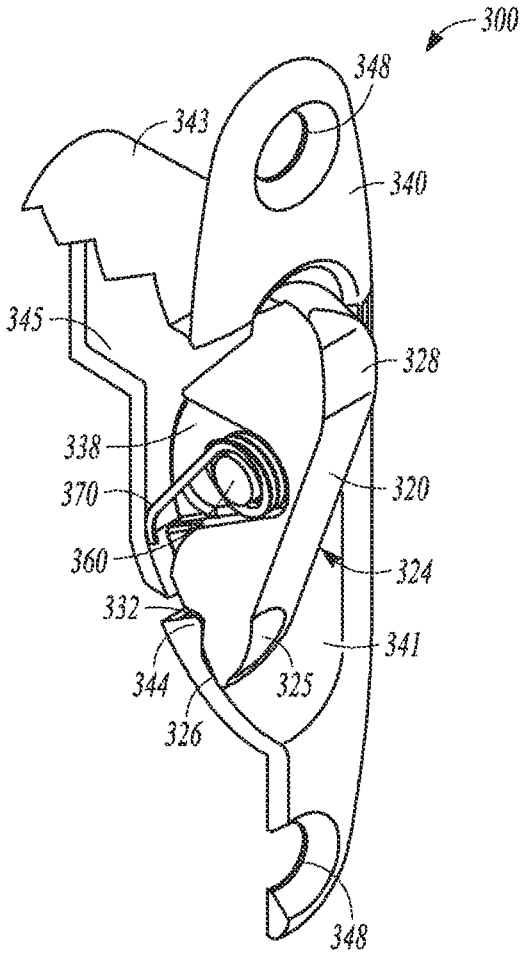
FIGS. 17A-17D illustrate a partially cutaway perspective view, a partially cutaway side view, a side view, and a front view, respectively, of an example of a sash limiter in a second position.
Figure 17B:
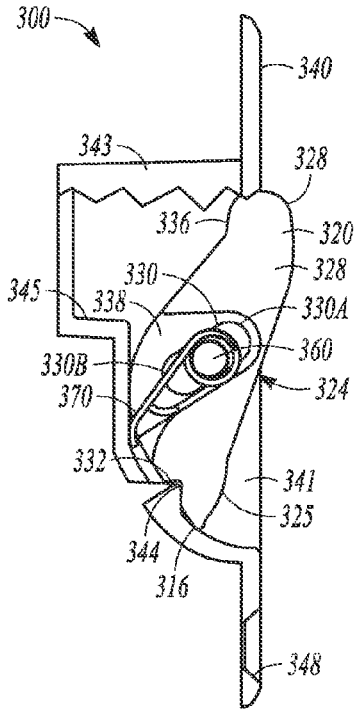
Figure 17C:
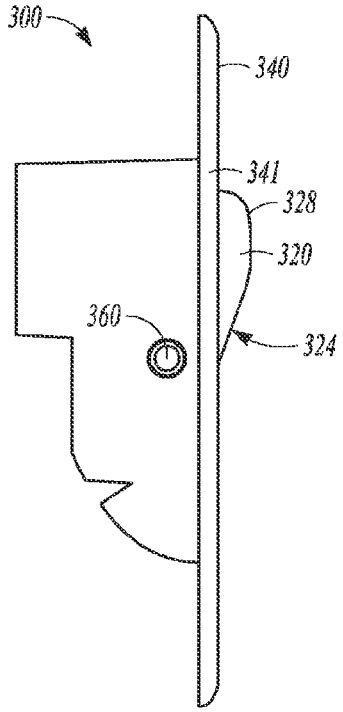
Figure 17D:
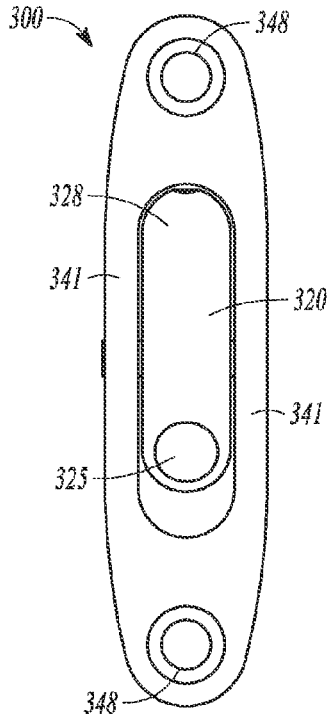

In some examples, the sash limiter 100 is attached to a portion of the window 10. In various examples, as shown in FIGS. 9-11, the sash limiter 100 is attached to the second sash 16. In other examples, the sash limiter 100 can be attached to other portions of the window provided the sash limiter 100 can function to limit opening of the window, as described herein. In an example, the sash limiter 100 includes a rocker 120 and abuse 140. In an example, the rocker 120 is selectively pivotable with respect to the base 140 between a first position 122 (e.g., a first abutting position shown in FIGS. 1A and 1B) and a second position 124 (e.g., a second resetting position shown in FIGS. 2A and 2B). In an example, the rocker 120 is pivotably coupled to the base 140 with a pin 160. In various examples, the sash limiter 100 need not include a base, in that the rocker 120 can be attached directly to a portion of the window 10. In a further example, the rocker 120 can be pivotably attached directly to the second sash 16. In a further example, the rocker 120 can be disposed within a channel or other hollowed out portion of the second sash 16 or other portion of the window 110. In a still further example, the rocker 120 can be pivotably engaged within the channel or other hollowed out portion of the second sash 16 or other portion of the window 10 using a pin.

It is contemplated that various materials are used for the sash limiter 100. For instance, in an example, the rocker 120 and the base 140 can be formed from die cast zinc. In a further example, the pin 160 can be formed from stainless steel. In other examples, other materials can be used for the components of the sash limiter 100, provided the sash limiter 100 is capable of functioning as described herein.

Referring to FIGS. 3A-3D, in some examples, the base 140 includes a ramp 142 (e.g., a rocker ramp) disposed proximate a bottom end of the base 140. The ramp 142, in various examples, is configured to interact with the rocker 120, as will be described in greater detail below, to facilitate movement of the rocker 120 from the second position 124 (the second resetting position shown in FIGS. 2A and 2B) to the first position 122 (the first abutting position shown in FIGS. 1A and 1B). The base 140, in an example, includes a landing 144 at a first end of the ramp 142 configured to retain the rocker 120 in the second position 124. In an example, the landing 144 includes a substantially flat surface configured to frictionally retain the rocker 120 in the second position 124. In an example, the landing 144 includes a pitch. In another example, the landing 144 can include a ledge, a ridge, and/or other structure to assist in retaining the rocker 120 in the second position 124. In some examples, the ramp 142 and/or the landing 144 is static with respect to the base 140. That is, the ramp 142 and/or the landing 144 is fixed with respect to the base 140 such that the ramp 142 and/or the landing 144 does not move with respect to the base 140. In further examples, the ramp 142 and/or the landing 144 is integrally formed with the base 140. Optionally, the landing 144 (e.g., the ledge and the like) is positioned at an elevated end of the ramp 142, for instance near an upper end of the ramp 142.

In some examples, the base 140 includes one or more holes 146 to retain the pin 160 therein for pivotably engaging the rocker 120. In an example, the base includes two holes 146 with one hole 146 disposed through each of two side walls 141 of the base 140. In an example, the holes 146 are disposed substantially along a horizontal center line of the base 140. In other examples, the holes 146 are disposed above or below the horizontal center line of the base 140. In various examples, the base 140 includes one or more fastener holes 148 configured to accept a fastener for engagement with the portion of the window 10. In other examples, other methods of attachment are contemplated, such as use of an adhesive, for instance.

Figure 4A:
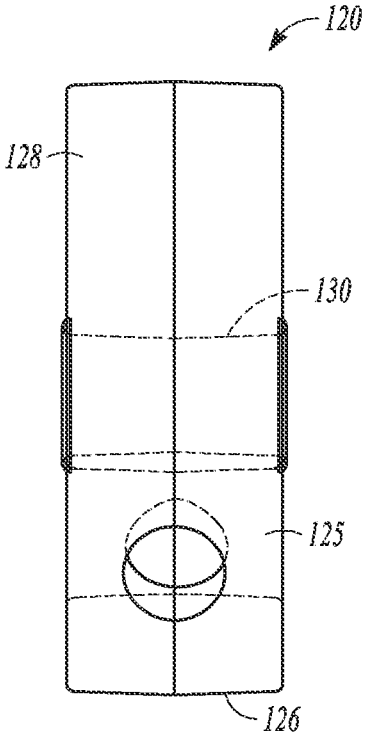
FIGS. 4A and 4B illustrate a front view and a side view, respectively, of an example of a rocker of a sash limiter.
Figure 4B:
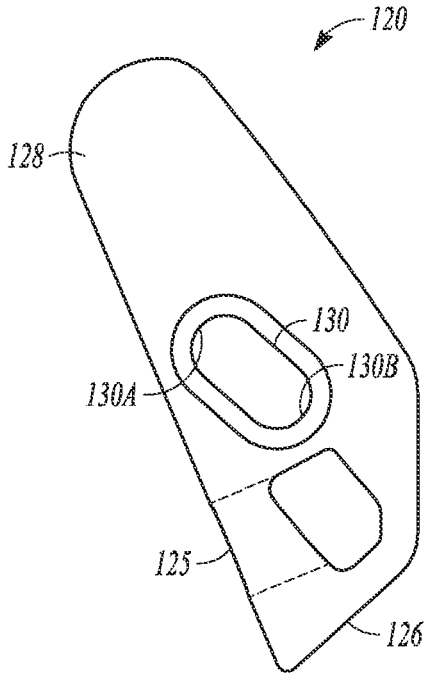

Referring to FIGS. 4A and 4B, in various examples, the rocker 120 includes an abutment feature 126. Optionally, the abutment feature 126 is adjacent a first end of the rocker. The abutment feature 126, in some examples, projects outwardly from the base 140 when the rocker 120 is in the first position 122 (e.g., a first abutting position with the abutment feature 126 away from the base 140). In an example, the abutment feature 126 includes a surface configured to abut the first sash 14 to inhibit (e.g., arrest) movement of the first sash 14 past the sash limiter 100 with the rocker 120 in the first position 122. In some examples, the rocker 120 includes a reset feature 128. Optionally, the reset feature 128 is adjacent a second end of the rocker (e.g., opposed to the first end of the rocker). In an example, the reset feature 128 projects outwardly from the base 140 when the rocker 120 is in the second position 124 (e.g., a second resetting position with the reset feature 128 away from the base 140). The reset feature 128, in an example, is configured to contact a portion of the first sash 14 in order to reset the rocker 120 from the second position 124 to the first position 122. In various examples, the rocker 120 includes a pivot hole 130 through the rocker 120. In an example, the pivot hole 130 is configured to accept the pin 160 therethrough to pivotably engage the rocker 120 with the base 140.

In an example, the pivot hole 130 is shaped like a substantially oblong slot to enable sliding motion (e.g., translational movement, such as by surface to surface sliding, between a rolling surface on one or more of the pin 160 or the slot and the like) between the rocker 120 and the base 140 in addition to allowing pivotable motion of the rocker 120 with respect to the base 140. For instance, the slot shaped pivot hole 130 includes first and second slot ends and a slot track therebetween, to form an oblong shape with the first and second slot ends at either end of the slot. The pin 160 is configured for sliding movement along the slot track, for instance from the first slot end to the second slot end or some portion therebetween. In one example, the first slot end 130B is near the first end of the rocker having the abutment feature 126 and the second slot end 130A is near the second end of the rocker having the reset feature 128. The slot track 131 is the elongate portion of the slot extending between the first and second slot ends 130A, B (one or both of the sides of the slot).

In some examples, with the slot-shaped pivot hole 130, the rocker 120 is configured to slide and pivot along the ramp 142 and/or the landing 144 between the first and second positions 122, 124. In the example in which the ramp 142 and/or the landing 144 is static with respect to the base 140, by allowing the rocker 120 to both pivot and slide with respect to the base 140 (pivoting about and sliding along the pin 160, for instance), the rocker 120 is able to move along the ramp 142 and rest on the landing 144, as described further below. That is, the rocker 120 follows a contour of the landing 144 and the ramp 142 through pivoting and sliding of the slot-shaped pivot hole 130 along the pin 160 with movement of the rocker 120 between the first and second positions 122, 124. In one example, the pin 160 is positioned within the slot shaped pivot hole 130 near the second slot end 130A (e.g., near to the second end of the rocker 120 having the reset feature) where the rocker 120 is in the first abutting position. In another example, the pin 160 is positioned within the slot shaped pivot hole 130 near the first slot end 130B (e.g., near to the first end of the rocker 120 having the abutment feature) where the rocker 120 is in the second resetting position.

In an example, the pivot hole 130 is substantially centrally located within the rocker 120. In another example, the pivot hole 130 is positioned off-center in the rocker 120 so the rocker 120 naturally pivots and/or slides into the first position 122. In this way, the first position 122 can be considered a default position. Stated another way, the rocker 120, in this example, is biased to the first position 122. The rocker 120, in an example, includes an actuation surface 125 configured to be pressed by a user in order to selectively place the rocker 120 into the second position 124. In an example, the actuation surface 125 is disposed below the pivot hole 130 of the rocker 120.

Referring to FIGS. 1A, 1B, 5A, 5B, and 10, the rocker 120 of the sash limiter 100 can be seen in the first position 122. The rocker 120, in some examples, in the first position 122 includes the abutment feature 126 of the rocker 120 disposed within a path of the first sash 14 (FIG. 10). In some examples, the abutment feature 126 is configured to abut a contact portion 15 of the first sash 14 and inhibit movement (e.g., arrest further movement) in the first direction A of the contact portion 15 of the first sash 14 past the abutment feature 126.

Figure 5A:
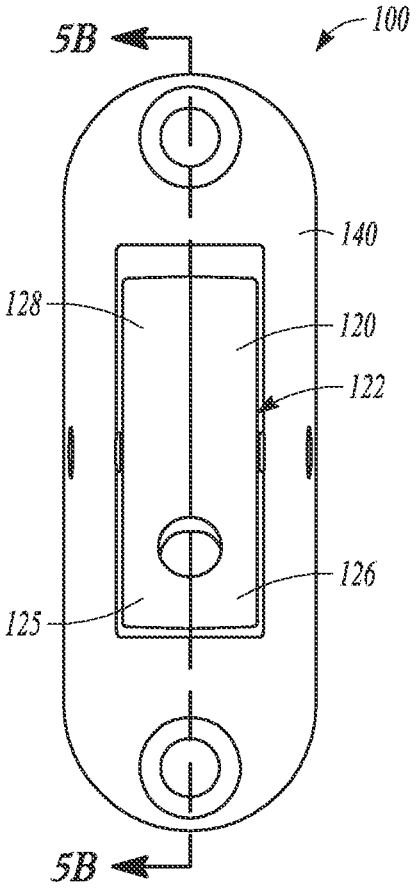
FIGS. 5A and 5B illustrate a front view and a cross-sectional view taken along line 5B-5B of FIG. 5A, respectively, of an example of a sash limiter in a first position.
Figure 5B:
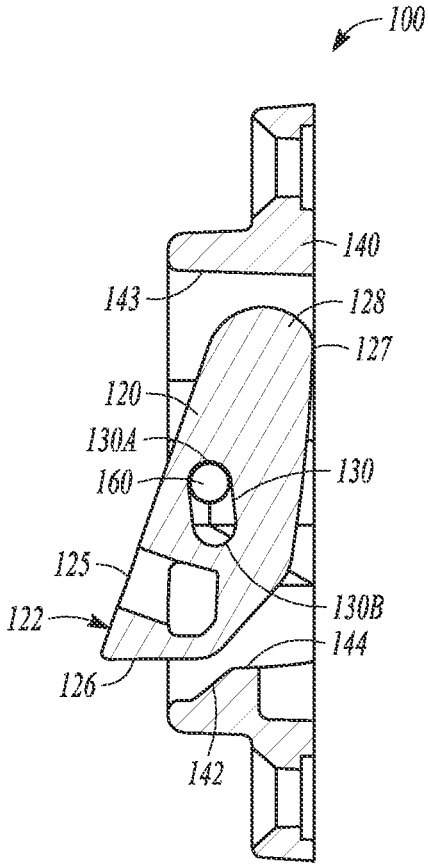
Figure 6A:
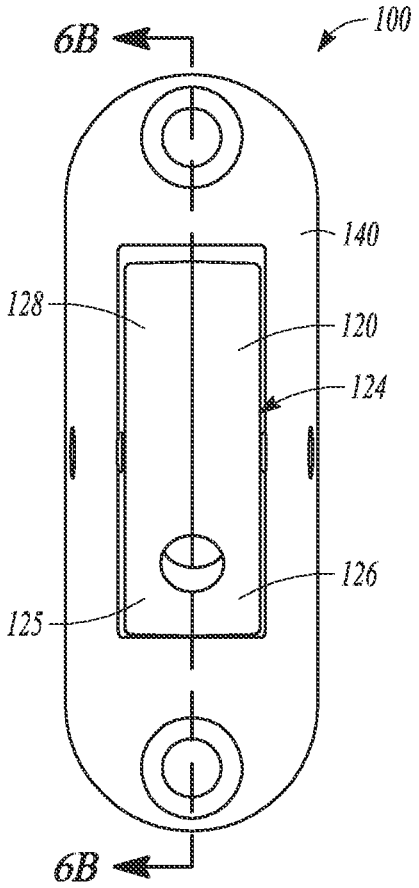
FIGS. 6A and 6B illustrate a front view and a cross-sectional view taken along line 6B-6B of FIG. 6A, respectively, of an example of a sash limiter in a second position.
Figure 6B:
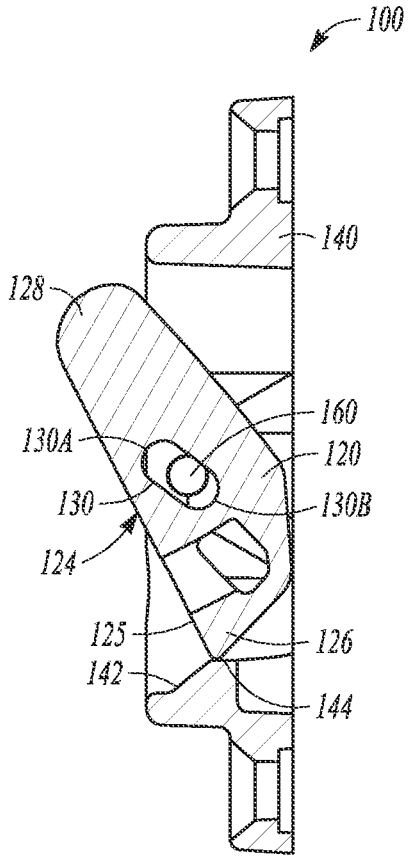

With specific reference to FIG. 5B, in an example, the rocker 120 in the first position 122 is disposed within the base 140 with the abutment feature 126 extending outwardly from the base 140. In an example, the rocker 120 hangs on the pin 160 in the first position 122 with the pin 160 disposed at a top end 130A of the pivot hole 130. In various examples, with its shape and weighting, the rocker 120 is substantially biased in the first position 122 by gravity. In an example, a portion of a back surface 127 of the rocker 120 abuts a surface (either the portion of the window 10 to which the sash limiter 100 is mounted or a back surface of the base 140 of the sash limiter 100). In an example, the portion of the back surface 127 is an upper portion of the back surface 127, such as a portion of the back surface 127 disposed above the pivot hole 130. In this way, should a force be applied to the abutment feature 126 for instance, an upward force from the first sash 14 contacting the abutment feature 126), such a force would tend to cause upward movement of the rocker 120 as the pivot hole 130 of the rocker 120 moves upwardly with respect to the pin 160, as well as pivoting about the pin 160 in a clockwise direction in FIG. 5B. A top wall 143 of the base 140, in an example, is configured to contact and constrain upward motion of the rocker 120 and the surface (again, either the portion of the window 10 to which the sash limiter 100 is mounted or a back surface of the base 140 of the sash limiter 100) is configured to constrain pivoting motion of the rocker 120. In this way, the sash limiter 100 in the first position 122, in various examples, is configured to contact the contact portion 15 of the sash 14 if the sash is moved in the direction A. That is, the rocker 120 is configured to inhibit motion of the sash 14 past the abutment feature 126 of the rocker 120 (e.g., the rocker 120 arrests further movement of the sash past the abutment feature). In this way, the rocker 120 of the sash limiter 100 can be set to the first position 122 to inhibit opening of the sash 14 pasta certain point to guard against someone (for instance, a small child) opening the window 10.

Referring to FIGS. 2A, 2B, 6A, and 6B, the rocker 120 of the sash limiter 100 can be seen in the second position 124. In various examples, the rocker 120 in the second position 124 includes the abutment feature 126 disposed out of the path of the first sash 14. In an example, the abutment feature 126 is rotated so that the abutment feature 126 is disposed at least partially within the base 140. In an example, the rocker 120 is retained in the second position 124 by the landing 144 at the first end of the ramp 142. In an example, the rocker 120 rests on the landing 144 at the first end of the ramp 142 of the base 140 with the rocker 120 in the second position 124. In an example, the rocker 120 is frictionally retained by the landing 144. In some examples, the user can apply a force (with a finger, for instance) on the actuation surface 125 to move the rocker 120 from the first position 122 to the second position 124. In an example, the user can apply a force directed inwardly with respect to the base 140 to slide the rocker 120 up the ramp 142 to be retained by the landing 144.

Such motion pivots the rocker 120 with respect to the base 140 and causes the rocker to ride up on the pin 160 so that the pin 160 is disposed closer to a bottom end 130B of the pivot hole 130. In an example, the reset feature 128 of the rocker 120 in the second position 124 extends outwardly from the base 140 and into the path of the first sash 14. In an example, the reset feature 128 of the rocker 120 is disposed above the pivot hole 130 to facilitate pivoting around the pin 160 when contacted by the first sash 14.

In various examples, the rocker 120 in the second position 124 is configured to allow the contact portion 15 of the first sash 14 to move in the first direction A past the abutment feature 126 (for instance, disposed within the base 140 and outside of the path of the first sash 14). In this way, the rocker 120 of the sash limiter 100 can be set to the second position 124 to allow the window 10 to open past the sash limiter 100, for instance, to allow someone to exit through the window 10 to egress the building in an emergency.

In various examples, the ramp 142 of the base 140 is configured to facilitate the rocker 120 to return to the first position 122 with movement of the contact portion 15 of the first sash 14 past the abutment feature 126 in the second direction B, will be described in more detail below. In an example, movement of the first sash 14 in the direction A causes the first sash 14 to contact the reset feature 128 of the rocker 120 in the second position 124. Contact with the reset feature 128 causes pivoting of the rocker 120 in a clockwise direction with respect to FIG. 6B. In an example, such pivoting of the rocker 120 causes the rocker 120 to slide or otherwise move off of the landing 144 and at least partially along the ramp 142 to an intermediate position 123, as described below.

Figure 7A:
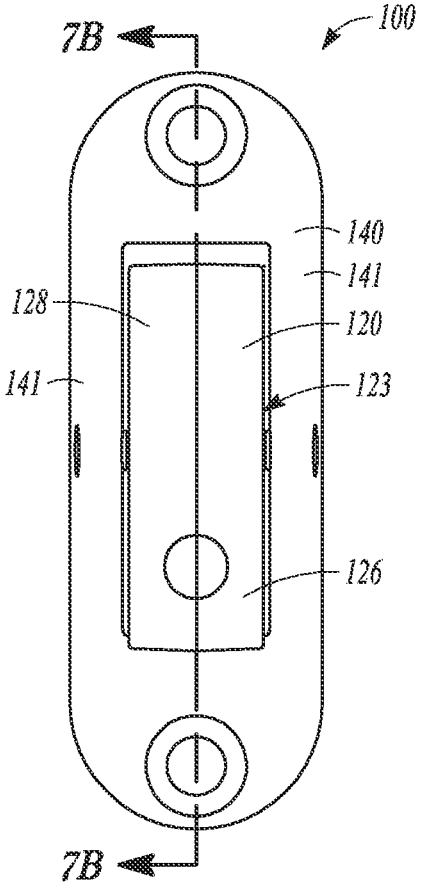
FIGS. 7A and 7B illustrate a front view and a cross-sectional view taken along line 7B-7B of FIG. 7A, respectively, of an example of a sash limiter in an intermediate position.
Figure 7B:
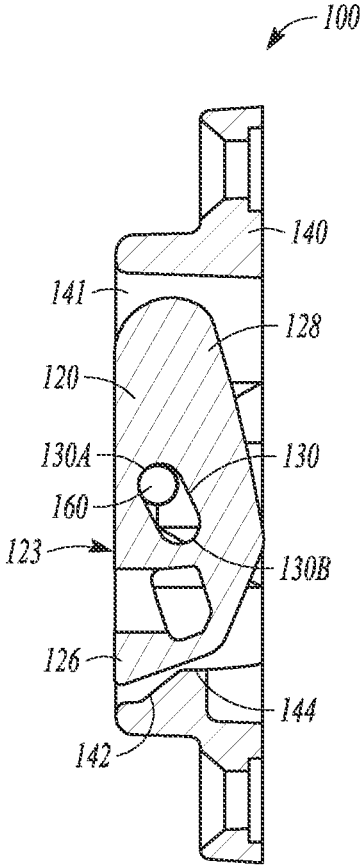
Figure 8A:
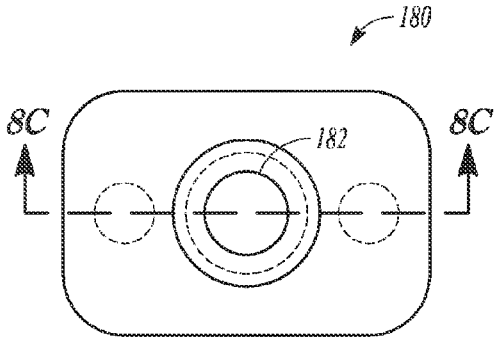
FIGS. 8A-8D illustrate a top view, a bottom view, a cross-sectional view taken along line 8C-8C of FIG. 8A, and a side view, respectively, of an example of a strike plate of a sash limiter.
Figure 8B:
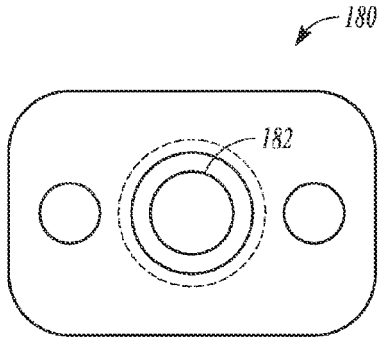
Figure 8C:
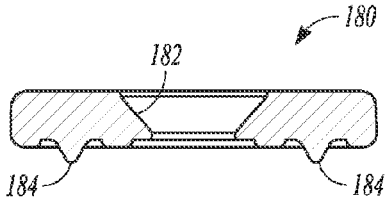
Figure 8D:
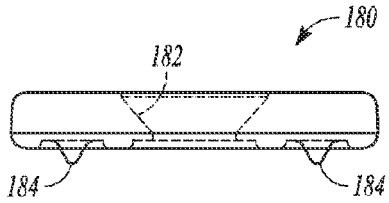

Referring to FIGS. 7A, 7B, and 11, the rocker 120 of the sash limiter 100 can be seen in the intermediate position 123. In an example, the rocker 120 is placed in the intermediate position 123 with contact of the first sash 14 with the reset portion 128 and causes the rocker 120 to slide off of the landing 144 and at least partially along the ramp 142. In an example, the rocker 120 in the intermediate position 123 is substantially flush with the side walls 141 of the base 140. In an example, the rocker 120 in the intermediate position 123 hangs on the pin 160 with the pin 160 disposed at the top 130A of the pivot hole 130. In an example, the weighting and/or the shape of the rocker 120 are such that, if unconstrained, the rocker 120 would pivot to the first position 122. In an example, the rocker 120 remains in the intermediate position 123 so long as an object (for instance, the first sash 14) remains in contact with the rocker 120. In a further example, the rocker 120 is configured to remain in the intermediate position 123 as long as an object (for instance, the first sash 14) remains in contact with a portion of the rocker 120 substantially at or below the pin 160 disposed within the pivot hole 130 of the rocker 120. If the object is no longer in contact with the portion of the rocker 120 or the object is in contact with a portion of the rocker 120 above the pin 160, the rocker 120 is free to pivot about the pin 160 in a clockwise direction in FIG. 7B to the first position 122.

With specific reference to FIG. 11, in an example, if the first sash 14 is moved in the direction A so that a top of the first sash 14 passes by the abutment feature 126 of the rocker 120 disposed in the first position 122 and contacts the reset feature 128 to move the rocker 120 from the first position 122 to the intermediate position 123. At this point, the first sash 14 can be moved further in the direction A, for instance to open the first sash 14 further and/or fully. Once the top (or any other portion) of the first sash 14 moves out of contact with the rocker 120, for instance, the portion of the rocker 120 below the pin 160, the rocker 120 can be configured to pivot into the first position 122. If the first sash 14 is moved in the direction A out of contact with the rocker 120, the rocker 120 can be configured to pivot to the first position 122. If the first sash 14 is then moved in the direction B, the rocker 120 can be configured to pivot from the first position 122 to the intermediate position 123 with contact of rocker 120 by the first sash 14, thereby allowing the first sash 14 to pass by the rocker 120 in the direction B (to close the window 10, for instance). Once the top of the first sash 14 is moved in the direction B past the abutment feature 126 of the rocker 120, the rocker 120 can be configured to pivot to the first position 122, thereby automatically resetting the rocker 120 to the first position 122 to enable the sash limiter 100 to inhibit opening of the first sash 14 beyond the sash limiter 100 to reduce the likelihood that a window 10 will be left in a condition capable of opening fully, which, in turn, reduces the likelihood that a person (for instance, a small child) will be able to open the window 10.

With automatic resetting of the rocker 120 to the first position 122, the user need not remember to reset the rocker 120 of the sash limiter 100 back to the first position 122 alter opening the window 10 lay. Instead, the rocker 120 of the sash limiter 100 resets itself and removes the user from a resetting operation. The user simply closes the window 10 to cause the rocker 120 of the sash limiter 100 to automatically reset to the first position 122 to inhibit opening of the window 10 past a certain point.

Referring to FIGS. 8A-8D, 10, and 11, in some examples, the contact portion 15 of the first sash 14 can include a strike plate 180 configured to contact the abutment feature 126 with the rocker 120 in the first position 122 (FIG. 10). In an example, the strike plate 180 is configured to protect the first sash 14 from damage from abutting the abutment feature 126. In an example, the strike plate 180 is sized and shaped to cover an area of the first sash 14 that can be contacted by the abutment feature 126 with the rocker 120 in the first position 122. In an example, the strike plate 180 is substantially rectangular in shape. In another example, the strike plate is substantially L-shaped, for instance, to fit around a corner of a portion of the window 10. In other examples, the strike plate is not limited to rectangular or L-shaped configurations and can include other shapes provided the strike plate is capable of functioning as described herein. The strike plate 180, in an example, includes a hole 182 configured to accept a fastener (such as a screw, nail, bolt, or the like) therethrough for fastening of the strike plate 180 to the first sash 14 (or any other portion of the window 10 that is selectively contacted by the rocker 120). In other examples, the strike plate 180 can be attached to the window in other ways, including, for instance, using an adhesive. In some examples, the strike plate 180 includes one or more grip features 184. In an example, the one or more grip features 184 can be configured to grip with the portion of the window 10 to which the strike plate 180 is engaged to inhibit rotation of the strike plate 180 with respect to the portion of the window 10 (for instance, rotation about a fastener disposed through the hole 182 and engaging the strike plate 180 to the portion of the window 10). In an example, the one or more grip features 184 include pointed projections extending from a bottom surface of the strike plate 180, the one or more grip features 184 configured to sink slightly into the portion of the window 10 in order to inhibit movement (for instance, rotation about the fastener) of the strike plate 180 once attached to the portion of the window 10. In an example, the strike plate 180 includes two grip features 184. In other examples, the strike plate 180 can include more or fewer than two grip features. In this way, the one or more grip features 184 help maintain the strike plate 180 in the proper position to protect the portion of the window 10 from potential damage resulting from contact with the abutment feature 126 of the rocker 120. In an example, the strike plate 180 can be formed from die cast zinc. In other examples, other materials can be used for the strike plate 180, provided the strike plate 180 is capable of functioning as described herein.

Referring to FIG. 9, in various examples, more than one sash limiter 1100 are used to selectively inhibit movement of the first sash 14. In an example, two sash limiters 100 are attached to a portion of the window 10 to selectively inhibit movement of the first sash 14. In a further example, the sash limiters 100 are attached to the second sash 16. By having more than one sash limiter 100, forces from contact between the first sash 14 and the abutment features 126 are spread out to reduce the chance of a failure of the sash limiter 100 (for instance, breakage of a portion of the sash limiter 100 or separation of the sash limiter 100 from the window 10). Use of more than one sash limiter 100 also provides a redundant system in that if one sash limiter 100 fails, there is at least one other sash limiter 100 to selectively inhibit movement of the first sash 14. Furthermore, having more than one sash limiter 100 requires the user to perform more than one action (for instance, positioning two or more sash limiters 100 in the second position 124) in order to open a window 10 fully, thereby reducing the likelihood that a small child can operate the sash limiters 100.

It is noted that placement of the one or more sash limiters 100 with respect to the window 10 can determine the amount that the window 10 can be opened before being constrained by the one or more sash limiters 100. For instance, referring to FIGS. 9-11, placement of the one or more sash limiters 100 on the second sash 16 at a location spaced a distance from the top of the first sash 14 (with the window 10 in a closed position) allows relative movement between the first and second sashes 14, 16 by that distance. That is, with the second sash 16 in the closed position and the one or more sash limiters 100 including rockers 120 in the first position 122, the first sash 14 can be opened a distance X (FIG. 10) before movement of the first sash 14 is limited by the one or more sash limiters 100. In various examples, the distance X is configured to reduce the likelihood that a small child can pass through a gap between the first sash 14 and the frame 12 with the one or more sash limiters 100 including rockers 120 in the first position 122. In an example, the distance X is configured to be four inches. In other examples, the distance X can be configured to be less than four inches. In still further examples, the distance X can be configured to be more than four inches. In some examples, the distance is configured to be adjustable by an adult user, for instance, by repositioning the one or more sash limiters 100 on the window 10.

With reference to FIGS. 1A-11, and with further reference to the description above, various examples of methods for selectively inhibiting movement of the first sash 14 of a window 10 are contemplated. In some examples, the first sash 14 is movable within the frame 12 of the window 10 in the first direction A (for instance, an opening direction) and the second direction B (for instance, a closing direction). In various examples, the second direction B is substantially opposite the first direction A. In an example, the window 10 further includes the second sash 16 movable within the frame 12 of the window 10. In some examples, at least one sash limiter 100 is attached to the window 10 for selectively inhibiting movement of the first sash 14. In an example, the at least one sash limiter 100 is attached to the second sash 16. In an example, the window 10 includes more than one sash limiter 100. In a further example, the window 10 includes two sash limiters 100.

Referring to FIGS. 1A, 1B, 5A, 5B, and 10, in various examples, the method includes selectively placing the rocker 120 of the at least one sash limiter 100 in the first position 122 with respect to the base 140 of the sash limiter 100. In an example, the method includes selectively placing the rocker 120 of each of two sash limiters 100 in the first position 122. In an example, the rocker 120 in the first position 122 includes the abutment feature 126 of the rocker 120 disposed within a path of the first sash 14. In an example, the abutment feature 126 is configured to abut the contact portion 15 of the first sash 14 and inhibit movement in the first direction A of the contact portion 15 of the first sash 14 past the abutment feature 126, as shown in FIG. 10. In some examples, the first position 122 is a default position of the rocker 120. Stated another way, the rocker 120, in these examples, is biased to the first position 122.

Referring to FIGS. 2A, 2B, 6A, and 613, in various examples, the method includes selectively placing the rocker 120 of the at least one sash limiter 100 in the second position 124 with respect to the base 140 of the at least one sash limiter 100. In various examples, selectively placing the rocker 120 of the at least one sash limiter 100 in the second position 124 includes applying a force on the rocker 120 to pivot the rocker 120 to rest on the landing 144 at the first end of the ramp 142 of the base 140. In an example, the rocker 120 in the second position 124 includes the abutment feature 126 disposed out of the path of the first sash 14. In an example, the rocker 120 in the second position 124 is configured to allow the contact portion 15 of the first sash 14 to move in the first direction A past the abutment feature 126. In an example, the base 140 includes the ramp 142 configured to cause the rocker 120 to return to the first position 122 with movement of the contact portion 15 of the first sash 14 past the abutment feature 126 in the second direction B.

In some examples, the method includes automatically returning the rocker 120 to the first position 122. Referring to FIGS. 7A, 7B, and 11, in an example, movement in the first direction A of the contact portion 15 of the first sash 14 past and in contact with the reset feature 128 of the rocker 120 pivots the rocker 120 off of the landing 144 and allows the rocker 120 to slide along the ramp 142 to the intermediate position 123. In an example, movement of the first sash 14 out of contact with the rocker 120 of the at least one sash limiter 100 allows the rocker 100 to pivot to the first position 122. In a further example, movement of the first sash 14 out of contact with a lower portion of the rocker 120 of the at least one sash limiter 100 allows the rocker 120 to pivot to the first position 122. In an example, further movement of the first sash 14 past the abutment feature 126 in the second direction B allows the rocker 120 to pivot to the first position 122, thereby automatically resetting the sash limiter 100 to the first position 122 and inhibiting uninterrupted movement of the first sash 14 in the direction A.

Referring to FIGS. 10 and 11, in an example, selectively placing the rocker 120 of the at least one sash limiter 100 in the first position 122 allows the first sash 14 to be moved between a closed position and an intermediate position (FIG. 10) in which the contact portion 15 of the first sash 14 contacts the abutment feature 126 of the rocker 120. In a further example, selectively placing the rocker 120 of the sash limiter 100 in the second position 124 allows the first sash 14 to be moved in the first direction A beyond the intermediate position (FIG. 11).

Referring to FIGS. 12-14D, an example of a sash limiter 200 is shown. In various examples, the sash limiter 200 is configured to be used in a manner similar to that described above with respect to the sash limiter 100 with a window 10 including a frame 12 and a first sash 14 movable within the frame 12 (FIGS. 9-11). In an example, the first sash 14 is movable within the frame 12 in a first direction A and a second direction B, the second direction B being substantially opposite the first direction A. In various examples, the direction A is an opening direction of the window 10 and direction B is a closing direction of the window 10. In an example, the window 10 includes a second sash 16. In some examples, the second sash 16 is also movable within the frame 12 in the first and second directions A, B. Although described with respect to a vertically opening and closing window, it is contemplated that the sash limiter 200 described herein can be used in other types of windows, such as, for instance, casement windows. Also, although described with respect to a double-hung window, it is contemplated that the sash limiter 200 described herein can be used in a window with a single movable sash. It is noted that the sash limiter 200 need not be limited to use with windows and can be further used with doors, sliding doors, swinging doors, patio doors, freezer doors, refrigerator doors, cabinet doors, skylights, roof hatch, roof access doors, and the like. In various examples, the sash limiter 200 can be used to selectively inhibit the opening of doors, sliding doors, swinging doors, patio doors, freezer doors, cabinet doors, skylights, roof hatches, roof access doors, and the like.

In some examples, the sash limiter 200 is attached to a portion of the window 10. In various examples, for instance, similar to that which is shown in FIGS. 9-11, the sash limiter 200 is attached to the second sash 16. In other examples, the sash limiter 200 can be attached to other portions of the window provided the sash limiter 200 can function to limit opening of the window, as described herein. In an example, the sash limiter 200 includes a rocker 220 and a base 240. In an example, the rocker 220 is selectively pivotable with respect to the base 240 between a first position 222 (FIGS. 13A-13D) and a second position 224 (FIGS. 14A-14D). In an example, the rocker 220 is pivotably coupled to the base 240 with a pin 260. In some examples, the base 240 is at least partially recessed within the second sash 16 of the window 10. For instance, a portion of the second sash 16 can be removed to form a hole, channel, groove, or the like sized and shaped to accept at least a portion of the base 240 therein. In an example, the base 240 is configured to be partially recessed within the portion of the window 10. In another example, the base 240 is configured to be fully recessed within the window 10, such that the base 240 is flush with or disposed below a surface of the window within which the base 240 is disposed. In various examples, the sash limiter 200 need not include a base, in that the rocker 220 can be attached directly to a portion of the window 10. In a further example, the rocker 220 can be pivotably attached directly to the second sash 16. In a further example, the rocker 220 can be disposed within a channel or other hollowed out portion of the second sash 16 or other portion of the window 10. In a still further example, the rocker 220 can be pivotably engaged within the channel or other hollowed out portion of the second sash 16 or other portion of the window 10 using a pin.

It is contemplated that various materials are used for the sash limiter 200. For instance, in an example, the rocker 220 and the base 240 can be formed from die cast zinc. In a further example, the pin 260 can be formed from stainless steel. In other examples, other materials can be used for the components of the sash limiter 200, provided the sash limiter 200 is capable of functioning as described herein.

In some examples, the base 240 includes a ledge 244 disposed proximate a bottom end of the base 240. The ledge 244, in various examples, is configured to interact with the rocker 220, as wilt be described in greater detail below, to retain the rocker 220 in the second position 224. In an example, the ledge 244 is configured to frictionally retain and/or mechanically engage the rocker 220 in the second position 224. In an example, the ledge 244 includes a ridge and/or other structure to at least assist in retaining the rocker 220 in the second position 224. In some examples, the rocker 220 includes an engagement feature 232 configured to engage with the ledge 244 of the base 240. In an example, the engagement feature 232 includes a detent-like configuration sized and shaped to selectively engage with the ledge 244 to selectively retain the rocker 220 in the second position 224. In a further example, the ledge 244 includes a detent feature (e.g., a first detent feature) configured to selectively engage with the engagement feature 232 of the rocker 220 to retain the rocker 220 in the second position 224. Optionally, the engagement feature 232 is a second detent feature included in a detent assembly of the engagement feature 232 and the slot shaped pivot hole 230 and the pin 260, described below. The slot shaped pivot hole 230 and the pin 260 cooperate to facilitate up and down movement of the engagement feature 232 for positioning against the ledge 244 (e.g., the first detent feature). In some examples, the ledge 244 is static with respect to the base 240. That is, the ledge 244 is fixed with respect to the base 240 such that the ledge 244 does not move with respect to the base 240. In further examples, the ledge 244 is integrally formed with the base 240.

In some examples, the base 240 includes one or more holes 246 to retain the pin 260 therein for pivotably engaging the rocker 220. In an example, the base includes two holes 246 with one hole 246 disposed through each of two side walls 241 of the base 240. In an example, the holes 246 are disposed substantially along a horizontal center line of the base 240. In other examples, the holes 246 are disposed above or below the horizontal center line of the base 240. In various examples, the base 240 includes one or more fastener holes 248 configured to accept a fastener for engagement with the portion of the window 10. In other examples, other methods of attachment are contemplated, such as use of an adhesive, for instance.

In various examples, the rocker 220 includes an abutment feature 226. The abutment feature 226, in some examples, projects outwardly from the base 240 when the rocker 220 is in the first position 222 (e.g., a first abutting position with the abutment feature 226 positioned away from the base 240). In an example, the abutment feature 226 includes a surface configured to abut the first sash 14 to inhibit movement of the first sash 14 past the sash limiter 200 with the rocker 220 in the first position 222. In some examples, the rocker 220 includes a reset feature 228 (for instance, a reset surface). In an example, the reset feature 228 projects outwardly from the base 240 when the rocker 220 is in the second position 224 (e.g., a second resetting position with the abutment feature reset feature 228 positioned away from the base 240). The reset feature 228, in an example, is configured to contact a portion of the first sash 14 in order to reset the rocker 220 from the second position 224 to the first position 227.

In various examples, the rocker 220 includes a pivot hole 230 through the rocker 220. In an example, the pivot hole 230 is configured to accept the pin 260 therethrough to pivotably engage the rocker 220 with the base 240. In an example, the pivot hole 230 is shaped like a substantially oblong slot to enable sliding motion (e.g., translational movement, such as by surface on surface sliding, engaging a roller on the pin 260 with the slot surface and the like) between the rocker 220 and the base 240 in addition to allowing pivotable motion of the rocker 220 with respect to the base 240. The pin 260 is configured for sliding movement along a slot track of the slot shaped pivot hole 230, for instance from a first slot end (to the second slot end or some portion therebetween.

In some examples, with the slot-shaped pivot hole 230, the rocker 220 is configured to slide and pivot out of or into engagement with the ledge 244 between the first and second positions 222, 224. In the example in which the ledge 244 is static with respect to the base 240, by allowing the rocker 220 to both pivot and slide with respect to the base 240 (pivoting about and sliding along the pin 260, for instance), the rocker 220 is able to slide up and over the ledge 244 while pivoting in order to be retained by the ledge 244 in the second position 224 or disengage from the ledge 244 to return to the first position 222, as described further below. That is, the rocker 220 follows a contour of the ledge 244 through pivoting and sliding of the slot-shaped pivot hole 230 along the pin 260 with movement of the rocker 220 between the first and second positions 222, 224. In one example, the pin 260 is positioned within the slot shaped pivot hole 230 near the second slot end 230A (e.g., near to the second end of the rocker 220 having the reset feature where the rocker 220 is in the first abutting position 222. In another example, the pin 260 is positioned within the slot shaped pivot hole 230 near the first slot end 23013 (e.g., near to the first end of the rocker 220 having the abutment feature) where the rocker 120 is in the second resetting position 224. The slot track 231 is the elongate portion of the slot extending between the first and second slot ends 230A, B (e.g., one or both sides of the slot).

In an example, the pivot hole 230 is substantially centrally located within the rocker 220. In another example, the pivot hole 230 is positioned off-center in the rocker 220 so the rocker 220 naturally pivots and/or slides into the first position 222, according to gravity, spring bias, and the like. In this way, the first position 222 can be considered a default position. Stated another way, the rocker 220, in this example, is biased to the first position 222. The rocker 220, in an example, includes an actuation surface 225 configured be pressed by a user in order to selectively place the rocker 220 into the second position 224. In an example, the actuation surface 225 is disposed below the pivot hole 230 of the rocker 220.

Referring to FIGS. 13A-13D, the rocker 220 of the sash limiter 200 can be seen in the first position 222. The rocker 220, in some examples, in the first position 222 includes the abutment feature 226 (e.g., a catch, surface, projection, and the like) of the rocker 220 disposed within a path of the first sash 14 (FIG. 10). In some examples, the abutment feature 226 is configured to abut a contact portion 15 of the first sash 14 and inhibit movement in the first direction A of the contact portion 15 of the first sash 14 past the abutment feature 226. In some examples, the contact portion 15 includes a strike plate similar to the examples of strike plates described above. In some examples, the strike plate is configured to protect the first sash from damage from abutting the abutment feature 226.

In an example, the rocker 220 in the first position 222 is disposed within the base 240 with the abutment feature 226 extending outwardly from the base 240. In an example, the rocker 220 hangs on the pin 260 in the first position 222 with the pin 260 disposed at or proximate atop end 230A (e.g., a second slot end) of the pivot hole 230. In various examples, with its shape and weighting, the rocker 220 is substantially biased into the first position 222 by gravity. In an example, a back surface 236 of the rocker 220 abuts a surface 245 of the base 240 of the sash limiter 200. In an example, the back surface 236 is disposed above the pivot hole 230. In this way, should a force be applied to the abutment feature 226 (for instance, an upward force from the first sash 14 contacting the abutment feature 226), such a force would tend to cause upward movement of the rocker 220 as the pivot hole 230 of the rocker 220 moves upwardly with respect to the pin 260, as well as pivoting about the pin 260 in a counterclockwise direction in FIG. 13B. A top wall 247 of the base 240, in an example, is configured to contact and constrain upward motion of the rocker 220 and the surface 245 of the base 240 of the sash limiter 200 and/or is configured to constrain pivoting motion of the rocker 220. In this way, the sash limiter 200 in the first position 222, in various examples, is configured to contact the contact portion 15 of the window 10 if the window 10 is moved in the direction A. That is, the rocker 220 is configured to inhibit motion of the window 10 past the abutment feature 226 of the rocker 220 through affirmative engagement between the abutment feature 226 and the contact portion 15 of the window 10 and between the back surface 236 of the rocker 220 and the surface 245 of the base 240. In this way, the rocker 220 of the sash limiter 200 can be set to the first position 222 to inhibit opening of the window 10 past a certain point to guard against someone (for instance, a small child) opening the window 10.

Referring again to FIGS. 12-14D, in some examples, the sash limiter 200 includes a rotation-limiting feature configured to limit rotation of the rocker 220 within the base 240. In some examples, the base 240 includes a tab 243 configured to selectively contact the rocker 220 to limit rotation of the rocker 220 with respect to the base 240. In an example, the tab 243 is configured to abut the rocker 220 to inhibit over-rotation of the rocker 220 with respect to the base 240. In a further example, the rocker 220 includes a groove 234 (e.g., a tab groove) located on the rocker 220 such that first and second surfaces 234A, 234B can come into contact with the tab 243 with rotation of the rocker 220, and, with the tab 243 abutting the first surface 234A of the groove 234 (FIG. 13B), rotation of the rocker 220 is inhibited in one direction, and, with the tab 243 abutting the second surface 234B of the groove 234 (FIG. 14B), rotation of the rocker 220 is inhibited in the other direction.

For instance, in some examples, the tab 243 of the base 240 can inhibit over-rotation of the rocker 220 (e.g., the tab 243 and the tab groove 234 cooperate to constrain rotation of the rocker), such as rotating back to the second position 224 with closing of the window 10, rather than rotating back to the first position 222. In some instances, with closing of the window 10 (for instance, relatively hard and/or fast closing of the window 10 in which the sash 14 essentially violently impacts the rocker 220 during closing), the rocker 220 could have the tendency to be knocked back into engagement with the ledge 244 and return to the second (non-stopping or non-engaging) position 224 with the sash 14. The position of the tab 243 and the interaction of the tab 243 within the groove 234, in some examples, or otherwise the interaction of the tab 243 with the rocker 220, inhibits e.g., constrains) the over-rotation of the rocker 220 to inhibit re-engagement of the rocker 220 in the second position 224 during closing of the window 10. In some examples, white the tab 243 inhibits over-rotation of the rocker 220 and re-engagement of the rocker 220 in the second position 224 in situations such as relatively hard closing of the window 10, the tab 243 does not inhibit placement of the rocker 220 in the second position under normal circumstances, such as a user placing the rocker 220 in the second position 224 in order to allow the user to open the window 10 past the one or more sash limiters 200. That is, in some examples, the relative positioning of the tab 243 with respect to the groove 234 is such that it allows rotation of the rocker 220 into the second position 224 under normal circumstances but does not allow rotation of the rocker 220 beyond the second position 224, thereby decreasing the likelihood of the rocker 220 settling back into the second position 224 after hard closing of the window 10. In various examples, with the tab 243 and groove 234 limiting rotation to the point (or just slightly beyond the point) of engagement of the rocker 220 in the second position 224, hard closing of the window 10 will cause the rocker 220, with abutment of the tab 243 with the first surface 234A of the groove 234, to rebound back toward the first position 222 and essentially skip over engagement of the rocker 220 in the second position 224.

Referring to FIGS. 14A-14D, the rocker 220 of the sash limiter 200 can be seen in the second position 224. In various examples, the rocker 220 in the second position 224 includes the abutment feature 226 disposed out of the path of the first sash 14. In an example, the abutment feature 226 is rotated so that the abutment feature 226 is disposed at least partially within the base 240. In an example, the rocker 220 is retained in the second position 224 by the ledge 244. In an example, the rocker 220 rests on the ledge 244 with the rocker 220 in the second position 224. In an example, the rocker 220 is frictionally retained by the ledge 244. In some examples, the engagement feature 232 of the rocker 220 is configured to engage with the ledge 244 of the base 240. In an example, the engagement feature 232 includes a detent-like configuration sized and shaped to engage with the ledge 244 to selectively retain the rocker 220 in the second position 224. In a further example, the ledge 244 (e.g., a detent feature) is configured to selectively engage with the engagement feature 232 of the rocker 220 to retain the rocker 220 in the second position 224. In some examples, the user can apply a force (with a finger, for instance) on the actuation surface 225 to move the rocker 220 from the first position 222 to the second position 224. In an example, the user can apply a force directed inwardly with respect to the base 240 to move the rocker 220 into engagement with the ledge 244.

Such motion pivots the rocker 220 with respect to the base 240 and causes the rocker 220 to ride up on the pin 260 so that the pin 260 is disposed closer to a bottom end 230B (e.g., first slot end) of the pivot hole 230. In an example, the reset feature 228 of the rocker 220 in the second position 224 extends outwardly from the base 240 and into the path of the first sash 14. In an example, the reset feature 228 of the rocker 220 is disposed above the pivot hole 230 to facilitate pivoting around the pin 260 when contacted by the first sash 14.

In various examples, the rocker 220 in the second position 224 is configured to allow the contact portion 15 of the first sash 14 to move in the first direction A past the abutment feature 226 (for instance, disposed within the base 240 and outside of the path of the first sash 14). In this way, the rocker 220 of the sash limiter 200 can be set to the second position 224 to allow the window 10 to open past the sash limiter 200, for instance, to allow someone to exit through the window 10 to egress the building in an emergency.

In various examples, movement of the first sash 14 in the direction A causes the first sash 14 to contact the reset feature 228 of the rocker 220 in the second position 224. Contact with the reset feature 228 causes pivoting of the rocker 220 in a counterclockwise direction with respect to FIG. 14B. In an example, such pivoting of the rocker 220 causes the rocker 220 to disengage, slid, or otherwise move off of the ledge 244 to an intermediate position, as described below.

In some examples, the rocker 220 is placed in the intermediate position with contact of the first sash 14 with the reset portion 228 and causes the rocker 220 to slide or otherwise move off of the ledge 244. In an example, the rocker 220 in the intermediate position is substantially flush with or recessed from edges of the side walls 241 of the base 240. In an example, the weighting and/or the shape of the rocker 220 are such that, if unconstrained, the rocker 220 would pivot to the first position 222 from the intermediate position. In an example, the rocker 220 remains in the intermediate position so long as an object (for instance, the first sash 14) remains in contact with the rocker 220. In a further example, the rocker 220 is configured to remain in the intermediate position as long as an object (for instance, the first sash 14) remains in contact with a portion of the rocker 220 substantially at or below the pin 260 disposed within the pivot hole 230 of the rocker 220. If the object is no longer in contact with the portion of the rocker 220 (in the intermediate position) or the object is in contact with a portion of the rocker 220 (in the intermediate position) above the pin 260, the rocker 220 is free to pivot about pin 260 in a counterclockwise direction in FIG. 14B to the first position 222.

In operation, in various examples, the sash limiter 200 works in a similar manner to that described above with respect to the sash limiter 100. That is, if the first sash is moved in an opening direction (corresponding to the direction A of FIG. 11) so that a top of the first sash passes by the abutment feature 226 of the rocker 220 disposed in the first position 222 and contacts the reset feature 228 to move the rocker 220 from the first position 222 to the intermediate position. At this point, the first sash can be moved further in the opening direction, for instance to open the first sash further and/or fully. Once the top (or any other portion) of the first sash moves out of contact with the rocker 220, for instance, the portion of the rocker 220 below the pin 260, the rocker 220 can be configured to pivot into the first position 222. If the first sash is moved in the opening direction out of contact with the rocker 220, the rocker 220 can be configured to pivot to the first position 222. If the first sash is then moved in a closing direction (corresponding to the direction B of FIG. 11), the rocker 220 can be configured to pivot from the first position 222 to the intermediate position with contact of rocker 220 by the first sash, thereby allowing the first sash to pass by the rocker 220 in the closing direction (to close the window, for instance). Once the top of the first sash is moved in the closing direction past the abutment feature 226 of the rocker 220, the rocker 220 is configured to pivot to the first position 222, thereby automatically resetting the rocker 220 to the first position 222 to enable the sash limiter 200 to inhibit opening of the first sash beyond the sash limiter 200 to reduce the likelihood that a window will be left in a condition capable of opening fully, which, in turn, reduces the likelihood that a person (for instance, a small child) will be able to open the window.

With automatic resetting of the rocker 220 to the first position 222, the user need not remember to reset the rocker 220 of the sash limiter 200 back to the first position 222 after opening the window fully. Instead, the rocker 220 of the sash limiter 200 resets itself and removes the user from a resetting operation. The user simply closes the window to cause the rocker 220 of the sash limiter 200 to automatically reset to the first position 222 to inhibit opening of the window past a certain point (for instance, four inches). In some instances, with closing of the window (for instance, relatively hard and/or fast closing of the window in which the sash essentially impacts the rocker 220 during closing), the rocker 220 could have the tendency to be knocked back into engagement with the ledge 244 and return to the second (non-engaging) position 224, rather than returning to the first (engaging) position 222. The position of the tab 243 (e.g. on the base 240) and the interaction of the tab 243 with the groove 234 of the rocker 220, in some examples, or otherwise the interaction of the tab 243 with the rocker 220, inhibits the over-rotation of the rocker 220 to inhibit re-engagement of the rocker 220 in the second position 224 during closing of the window. In some examples, while the tab 243 inhibits over-rotation of the rocker 220 and re-engagement of the rocker 220 in the second position 224 in situations such as relatively hard closing of the window, the tab 243 does not inhibit placement of the rocker 220 in the second position under normal circumstances, such as the user placing the rocker 220 in the second position 224 in order to allow the user to open the window 10 past the one or more sash limiters 200.

In various examples, more than one sash limiter 200 are used to selectively inhibit movement of the first sash. In an example, two sash limiters 200 are attached to a portion of the window to selectively inhibit movement of the first sash. In a further example, the sash limiters 200 are attached to the second sash. By having more than one sash limiter 200, forces from contact between the first sash and the abutment features 226 are spread out to reduce the chance of a failure of the sash limiter 200 (for instance, breakage of a portion of the sash limiter 200 or separation of the sash limiter 200 from the window). Use of more than one sash limiter 200 also provides a redundant system in that if one sash limiter 200 fails, there is at least one other sash limiter 200 to selectively inhibit movement of the first sash. Furthermore, having more than one sash limiter 200 requires the user to perform more than one action (for instance, positioning two or more sash limiters 200 in the second position 224) in order to open a window fully, thereby reducing the likelihood that a small child can operate the sash limiters 200.

It is noted that placement of the one or more sash limiters 200 with respect to the window can determine the amount that the window can be opened before being constrained by the one or more sash limiters 200. For instance, placement of the one or more sash limiters 200 on the second sash at a location spaced a distance from the top of the first sash (with the window in a closed position) allows relative movement between the first and second sashes by that distance. That is, with the second sash in the closed position and the one or more sash limiters 200 including rockers 220 in the first position 222, the first sash can be opened a distance (corresponding to the distance X of FIG. 10) before movement of the first sash is limited by the one or more sash limiters 200. In various examples, the distance is configured to reduce the likelihood that a small child can pass through a gap between the sash and the frame with the one or more sash limiters 200 including rockers 220 in the first position 222. In an example, the distance is configured to be four inches. In other examples, the distance can be configured to be less than four inches. In still further examples, the distance can be configured to be more than four inches. In some examples, the distance is configured to be adjustable by an adult user, for instance, by repositioning the one or more sash limiters 200 on the window.

Referring to FIGS. 15-17D, an example of a sash limiter 300 is shown. In various examples, the sash limiter 300 is configured to be used in a manner similar to that described above with respect to the sash limiter 100 with a window 10 including a frame 12 and a first sash 14 movable within the frame 12 (FIGS. 9-11). In an example, the first sash 14 is movable within the frame 12 in a first direction A and a second direction B, the second direction B being substantially opposite the first direction A. In various examples, the direction A is an opening direction of the window 10 and direction B is a closing direction of the window 10. In an example, the window 10 includes a second sash 16. In some examples, the second sash 16 is also movable within the frame 12 in the first and second directions A, B. Although described with respect to a vertically opening and closing window, it is contemplated that the sash limiter 300 described herein can be used in other types of windows, such as, for instance, easement windows. Also, although described with respect to a double-hung window, it is contemplated that the sash limiter 300 described herein can be used in a window with a single movable sash. It is noted that the sash limiter 300 need not be limited to use with windows and can be further used with doors, sliding doors, swinging doors, patio doors, freezer doors, refrigerator doors, cabinet doors, skylights, roof hatch, roof access doors, and the like. In various examples, the sash limiter 300 can be used to selectively inhibit the opening of doors, sliding doors, swinging doors, patio doors, freezer doors, cabinet doors, skylights, roof hatches, roof access doors, and the like.

In some examples, the sash limiter 300 is attached to a portion of the window 10. In various examples, for instance, similar to that which is shown in FIGS. 9-11, the sash limiter 300 is attached to the second sash 16. In other examples, the sash limiter 300 can be attached to other portions of the window provided the sash limiter 300 can function to limit opening of the window, as described herein. In an example, the sash limiter 300 includes a rocker 320 and a base 340. In an example, the rocker 320 is selectively pivotable with respect to the base 340 between a first position 322 (FIGS. 16A-16D) and a second position 324 (FIGS. 17A-17D). In an example, the rocker 320 is pivotably coupled to the base 340 with a pin 360. In some examples, the base 340 is at least partially recessed within the second sash 16 of the window 10. For instance, a portion of the second sash 16 can be removed to form a hole, channel, groove, or the like sized and shaped to accept at least a portion of the base 340 therein. 111 an example, the base 340 is configured to be partially recessed within the portion of the window 10. In another example, the base 340 is configured to be fully recessed within the window 10, such that the base 340 is flush with or disposed below a surface of the window within which the base 340 is disposed. In various examples, the sash limiter 300 need not include a base, in that the rocker 320 can be attached directly to a portion of the window 10. In a further example, the rocker 320 can be pivotably attached directly to the second sash 16. In a further example, the rocker 320 can be disposed within a channel or other hollowed out portion of the second sash 16 or other portion of the window 10. In a still further example, the rocker 320 can be pivotably engaged within the channel or other hollowed out portion of the second sash 16 or other portion of the window 10 using a pin.

It is contemplated that various materials are used for the sash limiter 300. For instance, in an example, the rocker 320 and the base 340 can be formed from die cast zinc. In a further example, the pin 360 can be formed from stainless steel. In other examples, other materials can be used for the components of the sash limiter 300, provided the sash limiter 300 is capable of functioning as described herein.

In some examples, the base 340 includes a ledge 344 disposed proximate a bottom end of the base 340. The ledge 344, in various examples, is configured to interact with the rocker 320, as will be described in greater detail below, to retain the rocker 320 in the second position 324. In an example, the ledge 344 is configured to frictionally retain and/or mechanically engage the rocker 320 in the second position 324. In an example, the ledge 344 includes a ridge and/or other structure to at least assist in retaining the rocker 320 in the second position 324. In some examples, the rocker 320 includes an engagement feature 332 (for instance, a recess and surfaces of the recess) configured to engage with the ledge 344 of the base 340. In an example, the engagement feature 332 includes a detent-like configuration sized and shaped to selectively engage with the ledge 344 (for instance, the ledge 344 being the detent and the engagement feature 332 including a recess) to selectively retain the rocker 320 in the second position 324. In a further example, the ledge 344 includes a detent feature configured to selectively engage with the engagement feature 332 of the rocker 320 to retain the rocker 320 in the second position 324. In some examples, the ledge 344 is static with respect to the base 340. That is, the ledge 344 is fixed with respect to the base 340 such that the ledge 344 does not move with respect to the base 340. In further examples, the ledge 344 is integrally formed with the base 340.

In some examples, the base 340 includes one or more holes 346 to retain the pin 360 therein for pivotably engaging the rocker 320. In an example, the base includes two holes 346 with one hole 346 disposed through each of two side walls 341 of the base 340. In an example, the holes 346 are disposed substantially along a horizontal center line of the base 340. In other examples, the holes 346 are disposed above or below the horizontal center line of the base 340. In various examples, the base 340 includes one or more fastener holes 348 configured to accept a fastener for engagement with the portion of the window 10. In other examples, other methods of attachment are contemplated, such as use of an adhesive, for instance.

In various examples, the rocker 320 includes an abutment feature 326. The abutment feature 326, in some examples, projects outwardly from the base 340 when the rocker 320 is in the first position 322. In an example, the abutment feature 326 includes a surface configured to abut the first sash 14 to inhibit movement of the first sash 14 past the sash limiter 300 with the rocker 320 in the first position 322. In some examples, the rocker 320 includes a reset feature 328. In an example, the reset feature 328 projects outwardly from the base 340 when the rocker 320 is in the second position 324. The reset feature 328, in an example, is configured to contact a portion of the first sash 14 in order to reset the rocker 320 from the second position 324 to the first position 322. In various examples, the rocker 320 includes a pivot hole 330 through the rocker 320. In an example, the pivot hole 330 is configured to accept the pin 360 therethrough to pivotably engage the rocker 320 with the base 340. In an example, the pivot hole 330 is shaped like a substantially oblong slot to enable sliding motion between the rocker 320 and the base 340 in addition to allowing pivotable motion of the rocker 320 with respect to the base 340. For instance, the slot shaped pivot hole 330 includes first and second slot ends and a slot track therebetween, to form an oblong shape with the first and second slot ends at either end of the slot. In some examples, with the slot-shaped pivot hole 330, the rocker 320 is configured to slide and pivot out of or into engagement with the ledge 344 between the first and second positions 322, 324. In the example in which the ledge 344 is static with respect to the base 340, by allowing the rocker 320 to both pivot and slide with respect to the base 340 (pivoting about and sliding along the pin 360, for instance), the rocker 320 is able to slide up and over the ledge 344 while pivoting in order to be retained by the ledge 344 in the second position 324 or disengage from the ledge 344 to return to the first position 322, as described father below. That is, the rocker 320 follows a contour of the ledge 344 through pivoting and sliding of the slot-shaped pivot hole 330 along the pin 360 with movement of the rocker 320 between the first and second positions 322, 324. In an example, the pivot hole 330 is substantially centrally located within the rocker 320. In another example, the pivot hole 330 is positioned off-center in the rocker 320 so the rocker 320 naturally pivots and/or slides into the first position 322 (e.g., the first abutting position). In this way, the first position 322 can be considered a default position. Stated another way, the rocker 320, in this example, is biased to the first position 322 because of gravity. The rocker 320, in an example, includes an actuation surface 325 configured to be pressed by a user in order to selectively place the rocker 320 into the second position 324 (e.g., the second abutting position). In an example, the actuation surface 325 is disposed below the pivot hole 330 of the rocker 320.

Referring to FIGS. 16A-16D, the rocker 320 of the sash limiter 300 can be seen in the first position 322. The rocker 320, in some examples, in the first position 322 includes the abutment feature 326 of the rocker 320 disposed within a path of the first sash 14 (FIG. 10). In some examples, the abutment feature 326 is configured to abut a contact portion 15 of the first sash 14 and inhibit movement in the first direction A of the contact portion 15 of the first sash 14 past the abutment feature 326. In some examples, the contact portion 15 includes a strike plate similar to the examples of strike plates described above. In some examples, the strike plate is configured to protect the first sash from damage from abutting the abutment feature 326.

In an example, the rocker 320 in the first position 322 is disposed within the base 340 with the abutment feature 326 extending outwardly from the base 340. In an example, the rocker 320 hangs on the pin 360 in the first position 322 with the pin 360 disposed at or proximate a top end 330A of the pivot hole 330. In various examples, with its shape and weighting, the rocker 320 is substantially biased in the first position 322 by gravity. In an example, a back surface 336 of the rocker 320 abuts a surface 345 of the base 340 of the sash limiter 300. In an example, the back surface 336 is disposed above the pivot hole 330. In this way, should a force be applied to the abutment feature 326 (for instance, an upward force from the first sash 14 contacting the abutment feature 326), such a force would tend to cause upward movement of the rocker 320 as the pivot hole 330 of the rocker 320 moves upwardly with respect to the pin 360, as well as pivoting about the pin 360 in a counterclockwise direction in FIG. 1613. A top wall 343 of the base 340, in an example, is configured to contact and constrain upward motion of the rocker 320 and the surface 345 of the base 340 of the sash limiter 300 and/or is configured to constrain pivoting motion of the rocker 320. In this way, the sash limiter 300 in the first position 322, in various examples, is configured to contact the contact portion 15 of the window 10 if the window 10 is moved in the direction A. That is, the rocker 320 is configured to inhibit motion of the window 10 past the abutment feature 326 of the rocker 320. In this way, the rocker 320 of the sash limiter 300 can be set to the first position 322 to inhibit opening of the window 10 past a certain point to guard against someone (for instance, a small child) opening the window 10.

Referring again to FIGS. 1.5-17D, in some examples, the sash limiter 300 includes a rotation-limiting feature configured to limit rotation of the rocker 320 within the base 340. In some examples, the sash limiter 300 includes a biasing element, such as a spring 370 (elastomeric element and the like), configured to limit rotation of the rocker 320 with respect to the base 340. In some examples, the spring 370 is configured to urge the rocker 320 to the first position 322. In further examples, the spring 370 is disposed between the rocker 320 and the base 340. In an example, the spring 370 is disposed around a portion of the pin 360. In an example, the spring 370 is disposed at least partially within a channel 338 of the rocker 320. In some examples, the spring 370 is a torsion spring. The spring 370, in further examples, includes a first leg 370A and a second leg 370B, wherein the first leg 370A abuts a portion of the rocker 320 and the second leg 370B abuts a portion of the base 340, such that movement of the rocker to the second position 324 compresses the spring 370 and increases the potential energy stored within the spring 370. Release of the potential energy of the spring 370 transitioning the kinetic energy at least assists in moving the rocker 320 back to the first position 322 from the second position 324. For instance, in some examples, with movement of the sash 14 in the direction A past the sash limiter 300, the rocker 320 is moved out of engagement with the ledge 344 and the potential energy of the spring 370 (or other biasing element) can assist moving the rocker 320 to the intermediate position. Then, as the sash 14 is moved in the direction B past the sash limiter 300, the spring 370 can further assist in moving the rocker 320 into the first position 322. In other examples, the spring 370 can inhibit over-rotation of the rocker 320, such as rotating back to the second position 324 with closing of the window 10, rather than rotating back to the first position 322. In some instances, with closing of the window 10 (for instance, relatively hard and/or fast closing of the window 10 in which the sash 14 essentially impacts the rocker 320 during closing), the rocker 320 could have the tendency to be knocked back into engagement with the ledge 344 and return to the second position 324. The interaction of the spring 370 with the rocker 320 inhibits the over-rotation of the rocker 320 to inhibit re-engagement of the rocker 320 in the second position 324 during closing of the window 10. In some examples, while the spring 370 inhibits over-rotation of the rocker 320 and re-engagement of the rocker 320 in the second position 324 in situations such as relatively hard closing of the window 10, the spring 370 does not inhibit placement of the rocker 320 in the second position under normal circumstances, such as a user placing the rocker 320 in the second position 324 in order to allow the user to open the window 10 past the one or more sash limiters 300. In various examples, the spring 370 is configured to assist in moving the rocker 320 to the first position 322 once the rocker 320 is moved out of engagement with the ledge 344, but is not strong enough to disengage the rocker 320 from the ledge 344 by itself.

Referring to FIGS. 17A-17D, the rocker 320 of the sash limiter 300 can be seen in the second position 324. In various examples, the rocker 320 in the second position 324 includes the abutment feature 326 disposed out of the path of the first sash 14. In an example, the abutment feature 326 is rotated so that the abutment feature 326 is disposed at least partially within the base 340. In an example, the rocker 320 is retained in the second position 324 by the ledge 344. In an example, the rocker 320 rests on the ledge 344 with the rocker 320 in the second position 324. In an example, the rocker 320 is frictionally retained by the ledge 344. In some examples, the engagement feature 332 of the rocker 320 is configured to engage with the ledge 344 of the base 340. In an example, the engagement feature 332 includes a detent-like configuration sized and shaped to engage with the ledge 344 to selectively retain the rocker 320 in the second position 324. In a further example, the ledge 344 includes a detent feature configured to selectively engage with the engagement feature 332 of the rocker 320 to retain the rocker 320 in the second position 324. In some examples, the user can apply a force (with a finger, for instance) on the actuation surface 325 to move the rocker 320 from the first position 322 to the second position 324. In an example, the user can apply a force directed inwardly with respect to the base 340 to move the rocker 320 into engagement with the ledge 344.

Such motion pivots the rocker 320 with respect to the base 340 and causes the rocker 320 to ride up on the pin 360 so that the pin 360 is disposed closer to a bottom end 330B of the pivot hole 330. In an example, the reset feature 328 of the rocker 320 in the second position 324 extends outwardly from the base 340 and into the path of the first sash 14. In an example, the reset feature 328 of the rocker 320 is disposed above the pivot hole 330 to facilitate pivoting around the pin 360 when contacted by the first sash 14.

In various examples, the rocker 320 in the second position 324 is configured to allow the contact portion 15 of the first sash 14 to move in the first direction A past the abutment feature 326 (for instance, disposed within the base 340 and outside of the path of the first sash 14). In this way, the rocker 320 of the sash limiter 300 can be set to the second position 324 to allow the window 10 to open past the sash limiter 300, for instance, to allow someone to exit through the window 10 to egress the building in an emergency.

In various examples, movement of the first sash 14 in the direction A causes the first sash 14 to contact the reset feature 328 of the rocker 320 in the second position 324. Contact with the reset feature 328 causes pivoting of the rocker 320 in a counterclockwise direction with respect to FIG. 17B. In an example, such pivoting of the rocker 320 causes the rocker 320 to disengage, slide, or otherwise move off of the ledge 344 to an intermediate position, as described below.

In some examples, the rocker 320 is placed in the intermediate position with contact of the first sash 14 with the reset portion 328 and causes the rocker 320 to slide or otherwise move off of the ledge 344. In an example, the rocker 320 in the intermediate position is substantially flush with or recessed from the side walls 341 of the base 340. In an example, the weighting and/or the shape of the rocker 320 are such that, if unconstrained, the rocker 320 would pivot to the first position 322 from the intermediate position. In an example, the rocker 320 remains in the intermediate position so tong as an object (for instance, the first sash 14) remains in contact with the rocker 320. In a further example, the rocker 320 is configured to remain in the intermediate position as long as an object (for instance, the first sash 14) remains in contact with a portion of the rocker 320 substantially at or below the pin 360 disposed within the pivot hole 330 of the rocker 320. If the object is no longer in contact with the portion of the rocker 320 or the object is in contact with a portion of the rocker 320 above the pin 360, the rocker 320 is free to pivot about the pin 360 in a counterclockwise direction in FIG. 17B to the first position 322.

In operation, in various examples, the sash limiter 300 works in a similar manner to that described above with respect to the sash limiter 100. That is, if the first sash is moved in an opening direction (corresponding to the direction A of FIG. 11) so that a top of the first sash passes by the abutment feature 326 of the rocker 320 disposed in the first position 322 and contacts the reset feature 328 to move the rocker 320 from the first position 322 to the intermediate position. At this point, the first sash can be moved further in the opening direction, for instance to open the first sash further and/or fully. Once the top (or any other portion) of the first sash moves out of contact with the rocker 320, for instance, the portion of the rocker 320 below the pin 360, the rocker 320 can be configured to pivot into the first position 322. If the first sash is moved in the opening direction out of contact with the rocker 320, the rocker 320 can be configured to pivot to the first position 322. If the first sash is then moved in a closing direction (corresponding to the direction B of FIG. 11), the rocker 320 can be configured to pivot from the first position 322 to the intermediate position with contact of rocker 320 by the first sash, thereby allowing the first sash to pass by the rocker 320 in the closing direction (to close the window, for instance). Once the top of the first sash is moved in the closing direction past the abutment feature 326 of the rocker 320, the rocker 320 is configured to pivot to the first position 322, thereby automatically resetting the rocker 320 to the first position 322 to enable the sash limiter 300 to inhibit opening of the first sash beyond the sash limiter 300 to reduce the likelihood that a window will be left in a condition capable of opening fully, which, in turn, reduces the likelihood that a person (for instance, a small child) will be able to open the window.

With automatic resetting of the rocker 320 to the first position 322, the user need not remember to reset the rocker 320 of the sash limiter 300 back to the first position 322 after opening the window fully. Instead, the rocker 320 of the sash limiter 300 resets itself and removes the user from a resetting operation. The user simply closes the window to cause the rocker 320 of the sash limiter 300 to automatically reset to the first position 322 to inhibit opening of the window past a certain point (for instance, four inches). In some instances, with closing of the window (for instance, relatively hard and/or fast closing of the window in which the sash essentially impacts the rocker 320 during closing), the rocker 320 could have the tendency to be knocked back into engagement with the ledge 344 and return to the second (non-engaging) position 324, rather than returning to the first (engaging) position 322. The interaction of the spring 370 with the rocker 320, in some examples, inhibits the over-rotation of the rocker 320 to inhibit re-engagement of the rocker 320 in the second position 324 during closing of the window and instead assists in moving the rocker 320 to the first position 322. In some examples, while the spring 370 inhibits over-rotation of the rocker 320 and re-engagement of the rocker 320 in the second position 324 in situations such as relatively hard closing of the window, the spring 370 does not inhibit placement of the rocker 320 in the second position under normal circumstances, such as the user placing the rocker 320 in the second position 324 in order to allow the user to open the window 10 past the one or more sash limiters 300.

In various examples, more than one sash limiter 300 are used to selectively inhibit movement of the first sash. In an example, two sash limiters 300 are attached to a portion of the window to selectively inhibit movement of the first sash. In a further example, the sash limiters 300 are attached to the second sash. By having more than one sash limiter 300, forces from contact between the first sash and the abutment features 326 are spread out to reduce the chance of a failure of the sash limiter 300 (for instance, breakage of a portion of the sash limiter 300 or separation of the sash limiter 300 from the window). Use of more than one sash limiter 300 also provides a redundant system in that if one sash limiter 300 fails, there is at least one other sash limiter 300 to selectively inhibit movement of the first sash. Furthermore, having more than one sash limiter 300 requires the user to perform more than one action (for instance, positioning two or more sash limiters 300 in the second position 324) in order to open a window fully, thereby reducing the likelihood that a small child can operate the sash limiters 300.

It is noted that placement of the one or more sash limiters 300 with respect to the window can determine the amount that the window can be opened before being constrained by the one or more sash limiters 300. For instance, placement of the one or more sash limiters 300 on the second sash at a location spaced a distance from the top of the first sash (with the window in a closed position) allows relative movement between the first and second sashes by that distance. That is, with the second sash in the closed position and the one or more sash limiters 300 including rockers 320 in the first position 322, the first sash can be opened a distance (corresponding to the distance X of FIG. 10) before movement of the first sash is limited by the one or more sash limiters 300. In various examples, the distance is configured to reduce the likelihood that a small child can pass through a gap between the sash and the frame with the one or more sash limiters 300 including rockers 320 in the first position 322. In an example, the distance is configured to be four inches. In other examples, the distance can be configured to be less than four inches. In still further examples, the distance can be configured to be more than four inches. In some examples, the distance is configured to be adjustable by an adult user, for instance, by repositioning the one or more sash limiters 300 on the window.

In some examples, various aspects described above with respect to one of the sash limiters 100, 200, 300 can be used interchangeably between any and all of the example sash limiters 100, 200, 300. That is, even though a particular feature is described and/or shown only with respect to one of the example sash limiters 100, 200, 300, this is not intended to be limiting. As such, in various examples, one or more features of one or more of the sash limiters 100, 200, 300 can be used in combination, even if such a combination is not explicitly described herein.

The various examples of the sash limiters 100, 200, 300 and methods thereof described above allow for a user to selectively limit or inhibit a window 10 from fully opening. Such a feature is believed to be advantageous for many reasons. For instance, limiting or inhibiting opening of the window 10 more than a certain distance can reduce if not eliminate the likelihood that a person (for instance, a small child) could fall out of the window 10. In various examples, the sash limiters 100, 200, 300 and methods thereof are further advantageous in that they selectively allow the window 10 to open for instance, for egress from a house, building, or other structure in an emergency. Moreover, in various examples, the sash limiters 100, 200, 300 and methods thereof are further advantageous in that they allow for the sash limiter 100, 200, 300 to automatically return to the first position 122, 222, 322 after being positioned in the second position 124, 224, 324 to open the window 10 beyond the sash limiter 100, 200, 300. Such a feature is advantageous in that it reduces the likelihood that a window 10 will be left in a condition capable of opening fully. That is, the user need not remember to reset the sash limiter 100, 200, 300 back to the first position 122, 222, 322 after opening the window 10 fully. Instead, the sash limiter 100, 200, 300 resets itself and removes the user from a resetting operation. In some examples, the sash limiter 100, 200, 300 can be used to selectively inhibit the opening of Objects other than windows, such as, for instance, doors, sliding doors, swinging doors, patio doors, freezer doors, cabinet doors, skylights, roof hatches, roof access doors, and the like. These advantages are not intended to be limiting. As such, additional advantages of the various example sash limiters 100, 200, 300 and methods described herein, including additional advantages described above, are contemplated.

Additional Notes

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof, or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." in this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. The above-described examples may be used alone, together, or in various combinations. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may be in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

The claimed invention is:

1. A limiter system comprising:

a base including a pin, a static rocker ramp, and a ledge near an elevated end of the static rocker ramp, the static rocker ramp rising from a lower end to the elevated end;

a rocker rotatably and translationally coupled with the pin, the rocker includes:

a first end including an abutment feature, a second end including a reset feature, and a slot including first and second slot ends and a slot track therebetween, the pin is translationally and rotatably received in the slot, wherein the pin is translational along the slot track between the first and second slot ends; and wherein the rocker is configured for positioning between a first abutting position and a second resetting position, and the first end of the rocker is slidably engaged along the static rocker ramp between the first abutting position and the second resetting position:

in the first abutting position, the abutment feature extends away from the base, and in the second resetting position, the reset feature extends away from the base, the abutment feature is nearer to the base than the reset feature, and the first end of the rocker rests on the ledge.

2. The limiter system of claim 1, wherein the abutment feature is received within the base in the second resetting position.

3. The limiter system of claim 1, wherein the first slot end is near the first end of the rocker, and the second slot end is near the second end of the rocker.

4. The limiter system of claim 3, wherein in the first abutting position the pin is positioned near the second slot end, and in the second resetting position the pin is positioned near the first slot end.

5. The limiter system of claim 1, wherein the ledge is a static ledge.

6. The limiter system of claim 1, wherein the pin is translationally engaged along the slot track between the first abutting position and the second resetting position.

7. The limiter system of claim 1, wherein the base includes a first detent feature, and the rocker and the base include a detent assembly, the detent assembly includes:

a second detent feature sized and shaped for engagement with the first detent feature in the second resetting position, and the slot and the pin.

8. The limiter system of claim 7, comprising a biasing element coupled between the base and the rocker, wherein the biasing element is configured to bias the rocker from the second resetting position to the first abutting position.

9. The limiter system of claim 1, wherein one of the base and the rocker includes a tab, and the other of the rocker and the base includes a tab groove, and the tab is slidably received in the tab groove between the first abutting position and the second resetting position.

10. A window system comprising:

a window including a frame and a first sash movable within the frame in opposed first and second directions, the first sash is movable along a sash movement path;

a sash limiter system coupled with the window, the sash limiter system includes:

a base including a static rocker ramp, a ledge near an elevated end of the static rocker ramp, the static rocker ramp rising from a lower end to the elevated end;

a rocker rotatably and translationally coupled with the base, the rocker including:

a first end including an abutment feature, and a second end including a reset feature;

wherein one of the base and the rocker includes a pin, and the other of the rocker and the base includes a slot, and the pin is translationally and rotatably received in the slot; and wherein the rocker is configured for positioning between a first abutting position and a second resetting position, and the rocker is guided between the first abutting position and the second resetting position according to guided translation of the pin along a slot track of the slot between first and second slot ends and sliding engagement of the first end along the static rocker ramp between the first abutting position and the second resetting position:

in the first abutting position, the abutment feature extends into the sash movement path and is configured to abut a portion of the first sash and arrest further movement of the sash in the first direction past the abutment feature, and in the second resetting position, the first end rests on the ledge, and the reset feature extends into the sash movement path and is configured to movably engage the portion of the first sash and bias the first end from the ledge as the first sash moves in the first direction past the reset feature.

11. The window system of claim 10, wherein the base includes a static rocker ramp, and the first end of the rocker is slidably engaged along the static rocker ramp between the first abutting position and the second resetting position.

12. The window system of claim 11, wherein the pin is configured to translate relative to the slot, and the first end of the rocker is configured to slide along the static rocker ramp from the second resetting position to the first abutting position after the reset feature movably engages the portion of the first sash in the second resetting position.

13. The window system of claim 12, wherein the pin is configured to translate relative to the slot track and the first end of the rocker is configured to fall according to gravity while being guided by the guided translation of the pin along the slot track.

14. The window system of claim 10, wherein the ledge includes a first detent feature, and the rocker and the base include a detent assembly, the detent assembly includes:

a second detent feature sized and shaped for engagement with the first detent feature in the second resetting position, and the slot and the pin.

15. The window system of claim 14 comprising a biasing element coupled between the base and the rocker, wherein the biasing element is configured to bias the rocker from the second resetting position to the first abutting position.

16. The window system of claim 10, wherein one of the base and the rocker includes a tab groove, and the other of the rocker and the base includes a tab movably coupled within the tab grove, and the tab and the tab groove are configured to constrain rotation of the rocker into the second resetting position from movement of the first sash in the second direction past the abutment feature and accordingly bias the rocker into the first abutting position.

17. The window system of claim 10 comprising a second sash within the frame, wherein the sash limiter system is coupled with the second sash.

18. A method for using a sash limiter comprising:

rotating and translating a rocker of a sash limiter from a first abutting position to a second resetting position, rotating includes rotating the rocker relative to a base including a pin, a static rocker ramp, and a ledge near an elevated end of the static rocker ramp, the static rocker ramp rising from a lower end to the elevated end, and translating includes translationally guiding the rocker over the pin between the first abutting position and the second resetting position, the rocker including a slot having a slot track with the pin slidably received in the slot track, and the slot track translationally guides the rocker over the pin, wherein:

in the first abutting position an abutment feature of the rocker at the first end of the rocker extends into a sash movement path of a first sash, and the pin is positioned relatively near a second slot end of the slot near a reset feature of the rocker and remote from the abutment feature, and in the second resetting position the reset feature extends into the sash movement path, the pin is positioned relatively near a first slot end of the slot near the abutment feature and remote from the reset feature, and the first end of the rocker rests on the ledge;

moving the first sash in a first direction and engaging the first sash with the reset feature, and engaging the first sash with the reset feature moves the first end of the rocker from rest off of the ledge in in the second resetting position, the first end of the rocker slidably engaged along the static rocker ramp between the first abutting position and the second resetting position;

moving the first sash in a second direction and disengaging the first sash from the rocker; and rotating and translating the rocker into the first abutting position after disengagement of the first sash from the rocker, the rocker translationally guided by the slot track over the pin.

19. The method of claim 18 comprising biasing the rocker toward the first abutting position from the second resetting position.

20. The method of claim 19, wherein biasing the rocker includes biasing the rocker with a spring coupled with the rocker.

21. The method of claim 19, wherein biasing the rocker includes sliding the first end of the rocker along the static rocker ramp.

22. The method of claim 19, wherein biasing the rocker includes translating the rocker according to gravity and rotating the first end of the rocker according to gravity.

23. The method of claim 18, wherein rotating and translating the rocker from the first abutting position to the second resetting position includes raising and lowering the first end of the rocker relative to the ledge including a detent feature, and raising or lowering the first end of the rocker translates the rocker over the pin.

24. The method of claim 18 comprising inhibiting movement of the first sash past the abutment feature after rotating and translating of the rocker into the first abutting position after disengagement of the first sash from the rocker.

25. The method of claim 18 comprising inhibiting the rocker from returning to the second resetting position with movement of the first sash in the second direction and disengaging the first sash from the rocker.

26. The method of claim 25, wherein inhibiting the rocker from returning to the second resetting position includes biasing the rocker with a biasing element toward the first abutting position with movement of the first sash in the second direction and disengaging the first sash from the rocker.

27. The method of claim 25, wherein inhibiting the rocker from returning to the second resetting position includes abutting a tab on the base with the rocker to inhibit the rocker from over-rotating to the second resetting position with movement of the first sash in the second direction and disengaging the first sash from the rocker.

* * * * *

UNITED STATES PATENT AND TRADEMARK OFFICE

CERTIFICATE OF CORRECTION

PATENT NO. : 8,776,440 B2
APPLICATION NO. : 13/328776
DATED : July 15, 2014
INVENTOR(S) : Sopkowiak et al.

It is certified that error appears in the above-identified patent and that said Letters Patent is hereby corrected as shown below:

In the Claims

In column 27, line 4, in Claim 18, after “ledge”, delete “in”, therefor

Signed and Sealed this
Twenty-first Day of October, 2014

Michelle K. Lee

Michelle K. Lee
*Deputy Director of the United States Patent and Trademark Office*